US010550517B2

(12) United States Patent
Engqvist et al.

(10) Patent No.: US 10,550,517 B2
(45) Date of Patent: Feb. 4, 2020

(54) APPARATUS AND METHOD FOR PROCESSING WHITE WATER IN A PAPER MACHINE

(71) Applicant: VALMET AKTIEBOLAG, Sundsvall (SE)

(72) Inventors: Elin Engqvist, Karlstad (SE); Leif Videgren, Karlstad (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 15/577,211

(22) PCT Filed: May 26, 2016

(86) PCT No.: PCT/EP2016/061936

§ 371 (c)(1),
(2) Date: Nov. 27, 2017

(87) PCT Pub. No.: WO2016/189101

PCT Pub. Date: Dec. 1, 2016

(65) Prior Publication Data

US 2018/0171554 A1 Jun. 21, 2018

Related U.S. Application Data

(63) Continuation of application No. PCT/EP2016/061935, filed on May 26, 2016.

(30) Foreign Application Priority Data

May 27, 2015 (SE) ..... 1550682
May 27, 2015 (SE) ..... 1550683

(51) Int. Cl.
*D21F 1/66* (2006.01)
*D21D 5/26* (2006.01)

(52) U.S. Cl.
CPC ..... *D21F 1/66* (2013.01); *D21D 5/26* (2013.01)

(58) Field of Classification Search
USPC ..... 162/190
See application file for complete search history.

(56) References Cited

U.S. PATENT DOCUMENTS 3,801,435 A 4/1974 Malashenko et al.
3,960,653 A 6/1976 Futcher et al.
(Continued)

FOREIGN PATENT DOCUMENTS

CN 101517161 A 8/2009
DE 29916681 U1 12/1999
(Continued)

OTHER PUBLICATIONS

State Intellectual Property Office of the P.R.C., First Office Action for Application No. 2016800308185, including Search Report, dated Nov. 27, 2018, 14 pages, China.
Valmet Aktiebolag, Applicant's Dec. 22, 2017 Response, including enclosures New Claim Set, Marked-up Figures, and Amendment to the Specification, to International Searching Authority's Sep. 20, 2016 International Search Report and Written Opinion for International Application No. PCT/EP2016/061936, 21 pages.
(Continued)

*Primary Examiner* — Mark Halpern
(74) *Attorney, Agent, or Firm* — Alston & Bird LLP

(57) ABSTRACT

Aspects provide for a Whitewater processing system suitable for managing an ejected Whitewater spray during operation of a paper or board making machine. A de-air system may provide for improved removal of air from the Whitewater. A calming system may reduce turbulence in a liquid flow, reducing turbulence in the flume. The de-air system and calming system may be disposed together or separately. Certain aspects may be implemented with a turbine (e.g., used to generate electricity from the Whitewater spray). Some aspects may provide for improved handling of variable spray velocities.

19 Claims, 12 Drawing Sheets

(56) References Cited

U.S. PATENT DOCUMENTS

| | | | |
|---|---|---|---|
| 4,028,174 | A | 6/1977 | Myren |
| 4,714,522 | A | 12/1987 | Holik |
| 6,096,120 | A | 8/2000 | Erlund et al. |
| 6,398,913 | B2 | 6/2002 | Eriksson |
| 8,784,538 | B2 | 7/2014 | Malm et al. |
| 2001/0018958 | A1 | 9/2001 | Eriksson |

FOREIGN PATENT DOCUMENTS

| | | | |
|---|---|---|---|
| DE | 19938799 | A1 | 2/2001 |
| EP | 1424437 | A1 | 6/2004 |
| WO | WO 2008/029427 | A1 | 3/2008 |
| WO | WO 2011/081594 | A1 | 7/2011 |
| WO | 102686796 | A | 9/2012 |
| WO | WO 2016/189100 | A1 | 12/2016 |
| WO | WO 2016/189100 | A4 | 12/2016 |

OTHER PUBLICATIONS

International Searching Authority, International Search Report and Written Opinion for International Application No. PCT/EP2016/061935, dated Sep. 16, 2016, 17 pages, European Patent Office, Netherlands.

International Searching Authority, International Search Report and Written Opinion for International Application No. PCT/EP2016/061936, dated Sep. 20, 2016, 11 pages, European Patent Office, Netherlands.

Swedish Patent and Registration Office, Office Action (Notice) for Application No. 1550682-7, dated Dec. 18, 2015, 10 pages, Sweden.

Swedish Patent and Registration Office, Office Action (Notice) for Application No. 1550683-5, dated Dec. 18, 2015, 6 pages, Sweden.

Response, as filed before the Chinese National Intellectual Property Association on Mar. 27, 2019. English translation of pending claims included.

APPARATUS AND METHOD FOR PROCESSING WHITE WATER IN A PAPER MACHINE

CROSS REFERENCE TO RELATED APPLICATIONS

This application is a National Stage Application, filed under 35 U.S.C. § 371, of International Application No. PCT/EP2016/061936, filed May 26, 2016, which application claims priority to Swedish Application No. 1550682-7, filed May 27, 2015, and Swedish Application No. 1550683-5, filed May 27, 2015; the contents of all of which as are hereby incorporated by reference in their entirety. This application is also a continuation of International Application No. PCT/EP2016/061935, filed May 26, 2016, which application also claims priority to Swedish Application No. 1550682-7, filed May 27, 2015, and Swedish Application No. 1550683-5, filed May 27, 2015; the contents of all of which as are hereby incorporated by reference in their entirety

BACKGROUND

1. Related Field

The present invention relates generally to the production of products from suspensions (e.g., as in tissuemaking, papermaking, boardmaking, and the like). More particularly, aspects relate to handling whitewater generated in a forming section.

2. Description of Related Art

Paper, tissue, board, and other products are often fabricated from a suspension (e.g., of cellulose in water). Such a suspension may be described as a stock. A forming section of a (e.g., paper or board) machine typically includes a headbox that injects stock between a loop of forming wire (e.g., a porous wire mesh or cloth) driven around a lead roll, and a loop of fabric (e.g., a felt or another forming wire), which is typically driven around a forming roll. Forces applied to the stock (e.g., via the headbox, the forming wire, the fabric, or the rolls) cause the water to pass through the forming wire, trapping the suspended material on the wire to form a web (e.g., of cellulose) between the forming wire and fabric. Water from the stock (so-called whitewater) is ejected through the forming wire. This "jet" or "spray" of whitewater is typically gathered and reused.

To reuse this spray of ejected whitewater, large amounts of entrained air should be removed from the water. Typically, the spray is decelerated and gathered to form a flowing stream of liquid water in a so-called "flume." The flume typically comprises a relatively long channel (e.g., several meters or more) through which the water flows relatively slowly, so that air bubbles can rise to the surface prior to reuse of the water. The flume is typically several meters (even tens of meters) long and over a meter (even several meters) wide. Because flow through the flume should be slow (allowing air bubbles to rise to the surface), the flume typically has a very shallow slope away from the forming section toward the fan pumps used to recycle the flume water. Such long flume lengths are typically necessary to maximize the tendency of air bubbles to rise up out of the flume water. It may be desirable to shorten flume length (while still removing undesired air), and so it may be advantageous to remove air (e.g., from the ejected whitewater) as quickly and efficiently as possible.

The reuse of water (e.g., to make additional stock with added suspended material) may be improved with more efficient air removal from the water. It is desirable to produce an efficient de-aeration process (e.g., to reduce complexity, cost, and/or energy consumption) associated with recycling the whitewater.

EP 1 424 437 A1 describes collecting drainage water from a forming roll in a twin-wire former of a paper machine. U.S. Pat. No. 4,714,522 discloses a system in which whitewater is caught in a whitewater trough which is provided with deflection vanes. U.S. Pat. No. 4,028,174 discloses a curved deflector for intercepting high velocity sprays of liquids. U.S. Pat. No. 6,096,120 discloses a double acting deaeration vessel. PCT patent application no. PCT/IT2007/000600 describes a wet forming paper machine with systems to reduce turbulence.

U.S. Pat. No. 8,784,538 describes a solution in which a first chamber part comprises a guide wall portion for redirecting drainage water in a predetermined second flow direction that differs from the first flow direction, said guide wall portion being formed by a plurality of curved guide walls which define a plurality of curved and substantially parallel flow channels for the drainage water and that the guide walls are arranged to interact with the drainage water in such a way that the drainage water is decelerated and air is forced out of the drainage water; and two substantially planar end walls, which are substantially parallel to the first flow direction and which are arranged on respective sides of and substantially orthogonally to the guide walls, wherein each end wall of at least one of the flow channels exhibits an opening that communicates with the flow channel for removing at least part of the air, which has been released from the drainage water in the flow channel by said interaction, from the first chamber part.

Many prior art solutions present certain challenges, particularly for modernized systems. FIGS. 1A and 1B illustrate prior art. FIG. 1A illustrates certain aspects of the deaeration unit disclosed in U.S. Pat. No. 8,784,538. A guiding portion 2 directs drainage water flow in the machine cross direction out of the forming section, and comprises a plurality of substantially parallel, curved deflectors 4, which direct the drainage water to an outlet 34 of guiding portion 2.

A deaeration unit 3 has its extension substantially in the cross direction of the paper machine. The deaeration unit 3 includes a plurality of dividing guide walls 10 of sheet metal and roof portion 23, which exhibit a curved or bent shape. Each guide wall 10, 23 exhibits a free upstream end 11 that is arranged at the inlet 8 (which receives drainage water from the guiding portion 2 via outlet 34).

FIG. 1B illustrates detail of the interface between the outlet 34 of the guiding portion 2 and the inlet 8 of the deaeration unit 3. At this interface, the trailing edges of the curved deflectors 4 are oriented across the free upstream ends 11 of the guide walls 10 in the deaeration unit 3. This orientation causes flow streams in the channels exiting the guiding portion 2 to be "bisected" or "chopped" by the free upstream ends 11 of guidewalls 10. Such chopping increases turbulence and mixing as the spray "bounces off" these surfaces (e.g., edges between the guiding portion 2 into the de-aeration unit 3). Additionally, a single channel in the guiding portion ejects water and air into a plurality of channels in the deaeration unit, and a single channel in the deaeration unit receives water and from a plurality of channels in the guiding portion. This "criss-cross" orientation provides for fluidic communication among channels (e.g., between channels in the guiding portion, 2 between channels in the de-aeration unit 3, and their combinations), as shown by the schematic arrows in FIG. 1B. With separate channels in fluidic communication, air pressure throughout the channels is expected to be substantially equal.

A paper machine may include a turbine, for example as described in U.S. Pat. No. 6,398,913 (also published as US 2001/0018958 A1). A turbine disposed in the flow of whitewater after it has passed through the forming wire may recover energy from the whitewater (e.g., to generate electricity with a generator powered by the turbine).

Many forming sections generate a "mist" of fine droplets of liquid. Typically, these droplets decelerate quickly, and spread around the forming section (and even throughout the room) via convection of air currents. The mist may deposit on surfaces (e.g., floors, steps) and render them unsafe. A mist may comprise residual fibers. A mist may deposit as a "slime" or otherwise form a slippery surface. A deposited mist may clog or otherwise degrade various surfaces (e.g., parts of the machine). A mist may prevent a user or inspector from efficiently seeing various parts of the machine. In some cases, a mist can create a sheet break (a costly manufacturing defect). It is typically desirable to minimize mist formation and/or minimize the deleterious effects associated with mist (e.g., deposition, slime, corrosion).

U.S. Pat. No. 3,801,435 teaches a "paper machine saveall with de-aerator." (Title) U.S. Pat. No. 3,960,653 teaches a "downflow control system for web making machines." (Title) German patent document no. DE 199 38 799 A1 teaches "Die folgenden Angaben sind den vom Anmelder eingereichten Unterlagen entnommen."

BRIEF SUMMARY

Various aspects may provide for improved deaeration of whitewater. A de-air system may remove air (e.g., by segregating a spray into liquid and gas phases). Segregation may enable the use of different forces on the different phases. A de-air system may comprise one or more channels designed to generate centrifugal forces within a liquid phase. These forces may enhance the removal of air bubbles from the liquid. Centrifugal forces within the liquid phase may cause gas bubbles to segregate to a gas/liquid interface. Pressure and/or flow control of the gas phase may be used to extract gas more efficiently.

A calming station may reduce turbulence (e.g., in a liquid comprising gas bubbles), which may enhance air removal in a flume, (e.g., by minimizing the "recirculation" of these bubbles deep into the flume via convection). A calming station may be designed to accommodate variable liquid flow velocities (e.g., that may occur when machine operating conditions change, such as changing from a first tissue type to a second tissue type). A calming station may be designed to operate with a turbine, particularly an adjustable turbine, and may comprise a gate and/or baffle designed according to a specific flow pattern (of condensed liquid) associated with the turbine (particularly a variable flow rate). An apparatus (e.g., a calming station) may include a gate and/or a baffle having a pattern (e.g., of slats, holes, bars, ridges, grooves, and the like). A gate may be adjustable. A variable pattern and/or adjustability may improve the management of different flow velocities. An apparatus may include a baffle, particularly a baffle comprising one or more holes, which may enhance fluid flow (e.g., reduce turbulence). A baffle may comprise one or more patterns. An apparatus may comprise a cleanout (e.g., above waterline or below waterline). A cleanout may include a suction mechanism configured to extract material from within the apparatus (e.g., a tube with holes). An apparatus may include a baffle and/or a gate shaped to induce an eddy in a flowing liquid, which may locally enhance settling. A cleanout may be disposed in the eddy, such that material within the eddy may be readily removed. A de-air system and calming station may be used together or separately; each may be implemented in a machine comprising a turbine or without a turbine.

A de-air system for processing a whitewater spray ejected from a forming wire in a forming section of a paper machine having a machine direction may comprise one or more channels. A system may comprise first and second channels with substantially no fluidic communication between the channels (e.g., between the inlet and outlet of each channel). A first channel may be defined at least in part by first walls that are shaped to direct a first portion of the whitewater spray away from the machine direction, preferably toward a side of the paper machine, such as in a cross direction. The first channel may be open at a first entrance proximate to the forming wire and may terminate at a first liquid outlet. The outlet may be defined at least in part by first terminal edges of the first walls, which may be configured to extend beneath a surface of liquid water at a flume level during operation of the machine, such that liquid may pass out of the outlet but gas may not pass into the channel via the outlet. A first air outlet in the first channel, typically located outside the frame of the machine, may provide for air evacuation from the first channel, preferably by a pump or fan or other suitable air movement apparatus.

The system may comprise a second channel defined at least in part by second walls shaped to direct a second portion of the whitewater spray away from the machine direction toward a side of the paper machine. The second channel may be open at a second entrance proximate to the forming wire and terminate at a second liquid outlet defined at least in part by second terminal edges of the second walls, which may be configured to extend beneath a surface of liquid water at a flume level. A second air outlet in the second channel, typically located outside the frame, may provide for air evacuation from the second channel, preferably by a pump or fan, which may be the same that of the first channel or different. In some implementations, locating an air outlet outside the frame may facilitate increased evacuation rates and/or relax the physical constraints associated with evacuating air from deep within the forming section (e.g., long ducts reaching across the entire machine).

In some embodiments, a system has a plurality of channels and is designed to minimize (e.g., prevent) substantial fluidic communication between the channels (e.g., except at their respective entrances and possibly air outlets). An overflow edge or other suitable apparatus may be used to fix a flume level such that liquid may exit the channels via the liquid outlets. Terminal edges of channels may be immersed below the surface of the liquid, so that gas is prevented from passing into the channels via the liquid outlets. Certain embodiments comprise a plurality of channels with no substantial fluidic communication between the channels (except at the whitewater inlets, and possibly the air outlets). After the whitewater spray has entered the channels via their respective entrances, each channel may segregate its respective portion of the spray into liquid and gas phases. The entrances may face a common "manifold" or other open portion. In each channel, the liquid may exit the channel via the liquid outlet (after which it may mix with other liquid). The gas may be evacuated via the respective air outlets (after which it may mix with other gas). Between the entrances and liquid outlets, and excluding the air outlets, the channels may be fluidically separated, such that (for example) different pressures may be maintained in different channels (e.g., via different pumping rates on the respective air outlets).

Air outlets for each channel may be used to evacuate air from the channels. In some embodiments, different evacuation rates are used for different air outlets. First and second air outlets may have different sizes. A channel that benefits from increased air evacuation (e.g., an outer channel) may have a larger air outlet and/or a higher pumping speed. A channel may have an outlet having an adjustable size.

In some cases, a first channel includes a first entrance that is disposed, laterally with respect to the machine direction, to receive whitewater spray from an outer portion of the forming wire. A second channel may have a second entrance disposed to receive spray from an inner portion. The first channel may have a higher evacuation rate than the second channel, which may maximize the removal of "mist" around the forming section. In some cases, the first channel may have a lower evacuation rate.

An air outlet, particularly a plurality of the air outlets, may be disposed in a ceiling of its respective channel, which may increase the preferential removal of gas (vs. liquid) via the air outlet. In some cases, at least one outlet is located, with respect to the machine direction, closer to an upstream wall than to a downstream wall of its respective channel. The portion of the ceiling having the air outlet(s) may be located outside the frame. In some implementations, a plurality of air outlets (evacuating channels located at different positions in the cross direction of the machine) are located outside the frame, particularly at different positions in the machine direction.

Momentum of the whitewater spray may be used to segregate a whitewater spray into liquid and gas phases. Momentum may be used to generate centrifugal forces in a liquid phase that segregate the liquid and gas into separate parts of a channel (e.g., the liquid to the outside of a curve, and the gas to the inside of the curved). An air outlet may be located in a parts that is expected to be associated with gaseous, rather than liquid, flow, and vice versa. Momentum may be used to drive gas bubbles out of the liquid.

A de-air system may comprise one or more channels having side walls. A channel may be defined at least in part by one or more side walls for which a majority, including greater than 80%, particularly substantially all, of the side wall is within 10 degrees of vertical, including within 5 degrees of vertical, including within 2 degrees of vertical, including substantially vertical side walls. Some of the side walls may be vertical; some may not. A majority of the side walls may be vertical. Substantially all of the side walls may be vertical. A vertical portion of the sidewall may extend past an air outlet (e.g., in a ceiling of the channel), such that the momentum of the liquid causes it to flow along the side wall past the outlet.

Certain channels include one or more optional internal walls within the channel to guide spray, liquid, and/or gas. In an embodiment, internal walls are disposed relatively far "downstream" in the channels, (e.g., after segregation of the spray and/or extraction of the gas from the liquid). In an embodiment, internal walls are disposed relatively far "upstream" and are oriented to smoothly direct spray down the channels with minimal "bounce back" of spray from the wall.

In some prior machines, a free upstream end intersecting a channel may disrupt flow through the channel, induce mixing, increase turbulence, and the like, and/or otherwise adversely affect performance. A de-air system described herein may comprise one or more channels shaped to redirect whitewater spray away from the machine direction, particularly toward a lateral direction, particularly a cross direction. The channel may be defined at least in part by channel walls, and including an entrance, air outlet and liquid outlet. In some embodiments, less than 5% of a cross sectional area of the channel, preferably less than 1% of the cross sectional area, preferably less than 0.1%, preferably substantially none of the cross sectional area, is intersected by a free upstream end of a part. In some cases, fluid may flow "smoothly" through the channel without being disrupted by the upstream end.

A calming station may be configured for use with a forming section of a paper machine to reduce turbulence in a liquid flowing into a flume of the paper machine. A calming station may be combined with a de-air station. A calming station and a de-air station may be implemented independently. A whitewater processing apparatus may comprise a de-air system and a calming station.

A calming station may include a liquid inlet, a liquid outlet, and a gate and/or baffle between the inlet and outlet. A gate and/or baffle may have a pattern (e.g., of holes, slats, bars, ridges, and the like) that affects fluid flowing in or around the gate. Various embodiments (gates, baffles) are illustrated with various patterns for simplicity; patterns for one may be implemented with the other.

A gate may comprise an adjustable gate configurable among two or more different positions that alter a flow (e.g., of liquid) through the calming station in different ways. A gate and/or baffle may comprise a first portion having a first pattern of slats, gaps, bars, ridges, grooves, bumps, holes, and the like, and a second portion having a second pattern. A gate and/or baffle may have a first region having a first pitch of slats, gaps, or holes through the gate (e.g., in a flow direction of fluid flow through and/or around the gate) and a second region having a second pitch. An adjustable gate may have different patterns or regions of slats, gaps, holes, and/or pitches. A pattern of slats, gaps, holes, and/or pitch may vary horizontally, vertically, and/or through the gate and/or baffle.

A calming station and/or a de-air system may include one or more gates and/or baffles (e.g., a first gate comprising an adjustable gate and a second gate comprising a fixed gate, and/or a first gate having a first pattern and a baffle having a second pattern, and/or a plurality of baffles with different patterns). In some cases, a first portion of a gate (adjustable or not) of a calming station has a first pattern of slats, holes, and the like, and a second portion of the gate has a second pattern of slats, holes, and the like. A first portion may have a first pattern and/or a first pitch (e.g., with respect to fluid flow through the gate or baffle) and a second portion may have a second pattern and/or pitch.

A calming station and/or a de-air system may comprise one or more baffles, particularly at the bottom of the calming station/de-air system. A baffle may be disposed and/or shaped to enhance fluid flow through the calming station. A baffle may reduce a velocity of the fluid. A baffle may redirect the fluid in a way that improves the extraction of air from the fluid. A baffle may be used to dissipate momentum of a liquid flowing through the calming station. A baffle may comprise one or more holes. A pattern of slats, gaps, holes, pitches, and/or other features may vary laterally and/or vertically across the baffle. A pattern may vary over one or more of a horizontal distance, a vertical distance, and through the gate or baffle. In an embodiment, a first gate and/or baffle has a pattern that varies vertically and as second gate and/or baffle has a pattern that varies horizontally. One or more of the gates may be adjustable.

A baffle may be integrated into a system in a relatively fixed way (e.g., welded, bolted). A gate may be relatively easily replaceable by a user. For example, a gate may be mounted near a hole shaped to allow the gate to be moved in and out of the system.

A de-air station may include a spray guide. A spray guide for redirecting a whitewater spray ejected from the forming wire may comprise one or more channels shaped to redirect the whitewater spray from the machine direction to a lateral direction, preferably a cross direction. The channels may be defined at least in part by channel walls comprising side walls for which a majority, preferably substantially all, of each channel side wall is substantially vertical. Vertical walls may reduce manufacturing complexity. Vertical walls may enhance the conversion of momentum in the machine direction to momentum in the cross direction.

A spray guide may include one or more channels defined at least in part by channel walls, entrances to the channels, and liquid outlets from the channels. For at least an upstream portion of the channel (e.g., in a region of the channel where the spray of liquid has not been segregated into gas and liquid phases), fewer than 10% of the channels, preferably none of the channels, may be intersected by a component that disrupts fluid flow through the channels (e.g., a free upstream end of a part such as a sheetmetal part). A free upstream end of a part may be a portion of the part that faces directly into fluid flowing through the channel. For example, at least a portion of the surface of the part may be characterized by a surface normal that is parallel to and in opposite direction of a flow vector of the fluid intersecting the portion. The minimization (and particularly elimination) of such free upstream ends may enable a smooth transition of spray momentum (from the headbox/forming roll) into linear momentum. Linear momentum may be used to segregate the liquid and gas phases, whereas random "mixing" of liquid and gas phases (as the spray scatters off surfaces intersecting the channel) may not improve air removal (and may inhibit it).

A roof drain may include a roof shaped to collect dripping water (e.g., residual water from the forming wire). A roof may be angled toward a gutter, which may terminate in a drainage hole, optionally with a downspout.

A method may comprise using curved channels and the downstream momentum of the whitewater to induce centrifugal forces in the whitewater. These forces may enhance the segregation of the liquid (e.g., to the outside of the curve) and gas (e.g., to the inside of the curve). The method may comprise evacuating the gas phase of the segregated whitewater (e.g., pumping the air out). The air may be pumped out proximate to (e.g., immediately downstream of) a region of the channel that induces a maximum centrifugal force on the liquid flowing in the channel.

A method for removing air from whitewater in a forming section of a paper machine may comprise dividing a spray of whitewater from a forming wire among a plurality of channels, each channel having a liquid outlet comprising terminal edges of walls of the channels, setting a flume level such that the terminal edges are immersed in the flume to an amount sufficient to prevent substantial flow of air into the channels from the liquid outlets, and evacuating the air in the channels using a pump, preferably using a channel configuration in which the only fluidic communication between the channels is provided at the entrances to the first and second channels.

Certain implementations include a turbine configured to harvest energy from the whitewater spray. A de-air station may be disposed downstream of the turbine. A calming station may be disposed downstream of a turbine (e.g., downstream of a de-air station). A de-air station and/or a calming station may be designed to accommodate variable flow velocities, as may occur in a turbine implementation (e.g., when the turbine is engaged/disengaged).

DETAILED DESCRIPTION OF VARIOUS EMBODIMENTS

Figure 1A:
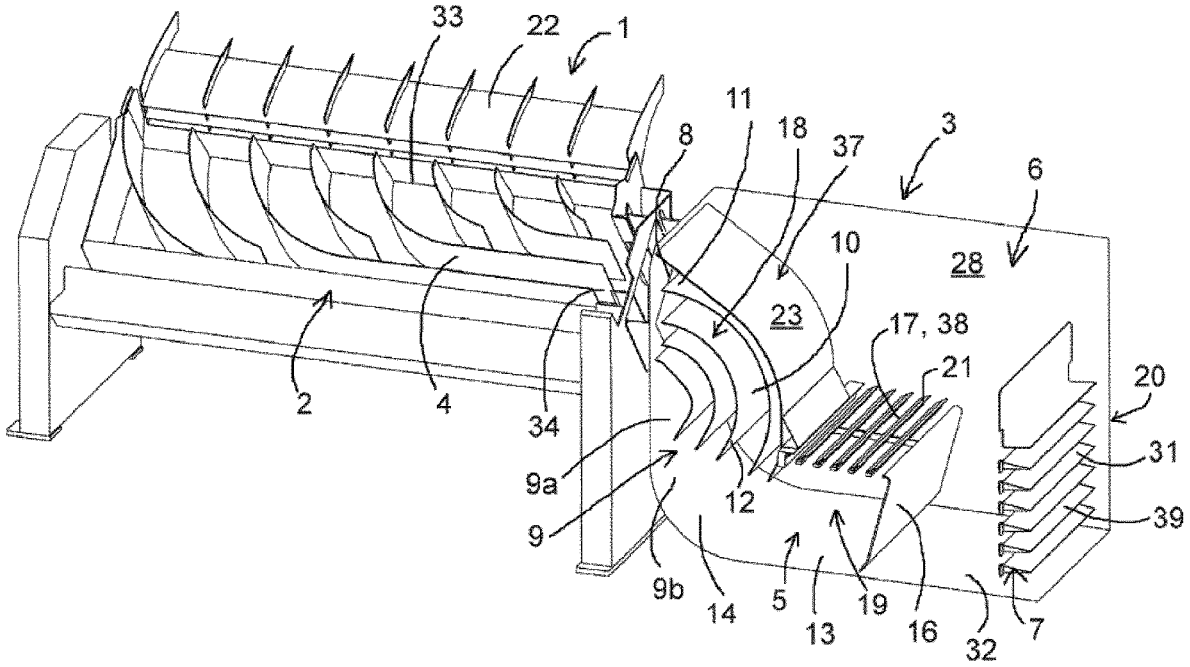
FIG. 1A (PRIOR ART)
FIGS. 1A and B illustrate prior art.
Figure 1B:
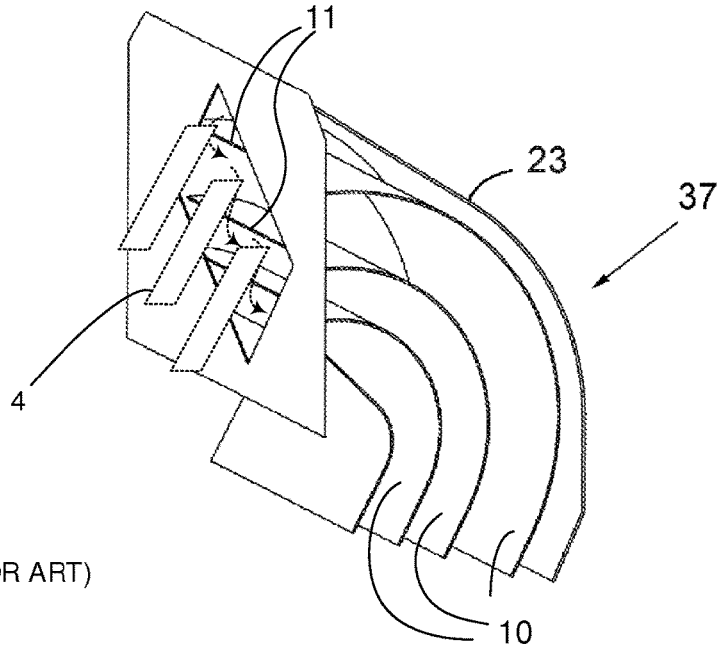
FIG. 1B (PRIOR ART)

A whitewater spray may be gathered and/or condensed to a liquid in one or more channels. Channels may be integrated into a spray guide system and/or a de-air system. Curves in the channels may impart centripetal forces to the liquid. Centrifugal forces in the liquid may cause air bubbles in the liquid to "rise" to the surface (e.g., in an "inward" direction opposite that taken by the denser water, as in a centrifuge). An apparatus may have one channel. An apparatus may have two, three, four, six, eight, ten, or even twelve or more channels.

Air may be removed in a de-air system. In some cases, air is removed with one or more pumps (e.g., fans), which may evacuate air in a channel (e.g., reducing air pressure within the channel to enhance air removal). Centrifugal forces may enhance the removal of air bubbles from liquid whitewater. Air removal may be enhanced with a combination of centrifugal force (acting on the liquid phase to drive out air bubbles) and reduced air pressure/increased air evacuation rate (to remove the air bubbles).

In an embodiment, a channel "smoothly" causes the spray to segregate (onto a curved wall) and flow along the wall. For example, a surface may be designed such that the (predicted) angle of attack of incoming spray does not exceed 30 degrees, and preferably does not exceed 20 degrees, or even 10 degrees. The design may cause the spray to collect along the surface, forming a film, rather than "bounce off" the surface. Preferably, the momentum of the film is maintained as the film follows a curved portion of the wall, where centrifugal forces drive (e.g., large) air bubbles toward the inside of the curve. Subsequently (e.g., after the bubbles have been segregated out of the liquid), air is removed from above the liquid. Smaller bubbles not removed by centrifugal forces may be removed in the flume.

Vertically oriented walls (which typically curved) may induce an axial acceleration that drives air bubbles inwards (with respect to a channel radius) when a film of water travels along the outside wall of the channel. Channels may be designed such that liquid momentum causes the liquid flowing through a channel to preferentially flow along a portion (e.g., the outside of a curve). An air outlet from the channel may be preferentially located in another portion (e.g., near the inside of a curve) where liquid is not preferentially located. An air outlet may be in a ceiling of the channel. Vertically oriented walls may improve the manufacturability of a device (e.g., as opposed to devices having walls with complex curvatures).

Some machines do not generate a uniform spray density (laterally) across the forming wire. For example, an "outer part" of the forming section may generate a spray having more air and/or smaller droplets than that generated in an "inner part" of the forming section. The spray from the outer part may be more like a "mist" of fine droplets that quickly decelerate. This mist may spread laterally, vertically, and the like (creating almost a "fog" around the forming section). This mist may condense, and even "rain" on the various apparatus around and within the forming section. In contrast, the spray in the inner part of the forming section may comprise larger droplets having significant forward momentum that readily carries them into the channel.

To accommodate variable spray densities/velocities/droplet sizes, various embodiments comprise two or more channels that are substantially fluidically separated. An outer channel may be located proximate to an outer part of the machine (e.g., having a more "mist-like" spray that requires more of a "vacuum cleaner" effect to prevent its dispersal around the machine. An inner channel may be located toward the center of the machine, (e.g., where the momentum of the spray is sufficient to propel the spray into the channel). Fluidic separation between channels may enable the use of different evacuation rates (e.g., via the respective air outlets of the separate channels). An increased evacuation rate of an outer channel may enable a "vacuuming" of the mist (associated with the outer part of the machine) into an outer channel without "over-vacuuming" the inner channels (not requiring additional suction). As such, energy devoted to evacuating the channels may be preferentially directed toward those channels most in need of evacuation.

Pumping speed control over the separate channels may be implemented in a variety of ways. Channels may have different sized air outlets and/or adjustable air outlets to improve the efficiency of air removal with respect to pump energy. Channels may have different pumps or fans (e.g., outer channels may have a higher speed pump than that pumping inner channels)

A calming station may be configured to reduce turbulence in liquid water (e.g., prior to the flume). The removal of small air bubbles in a flume may be improved by reducing convection in the flume (which might circulate small air bubbles back down to the bottom). A calming station may reduce turbulence in the liquid water ejected from the forming section (e.g., via a de-air system), which may improve air removal in the flume. A calming station may increase the uniformity of flow of the water. For example, in a computer simulation of expected flow velocities (e.g., over a cross section of the flowing liquid) a calming station may reduce the variability in the flow velocity vectors (e.g., in a lateral direction, a vertical direction, orthogonal to the flow direction, and the like). In some machines, an inner channel of an apparatus directing water flow out of the machine direction comprises a smaller radius of curvature, and an outer channel has a larger radius of curvature. Water flowing from the inner channel may have a higher velocity. A calming station and/or de-air system may comprise a baffle and/or gate having a first pattern for water flowing from the "inner channel" and a second pattern for water flowing from the outer channel.

Certain aspects may incorporate a turbine. A turbine may be disposed (e.g., immediately after the forming wire) to harvest the kinetic energy of the whitewater spray. During machine operation, engagement of a turbine typically results in decreased whitewater velocities (post-turbine), and disengagement of the turbine results in increased whitewater velocities (post-turbine). Certain aspects of a de-air station and/or a calming station may provide for improved management of these different flow velocities. Apparatus may be adjusted between a first position (for high velocity flow) and a second position (for low velocity flow). Apparatus may be inserted or removed to accommodate different velocities. Apparatus may have patterns designed to accommodate variations in the flow field that occur as the aggregate flow velocity changes.

Figure 2:
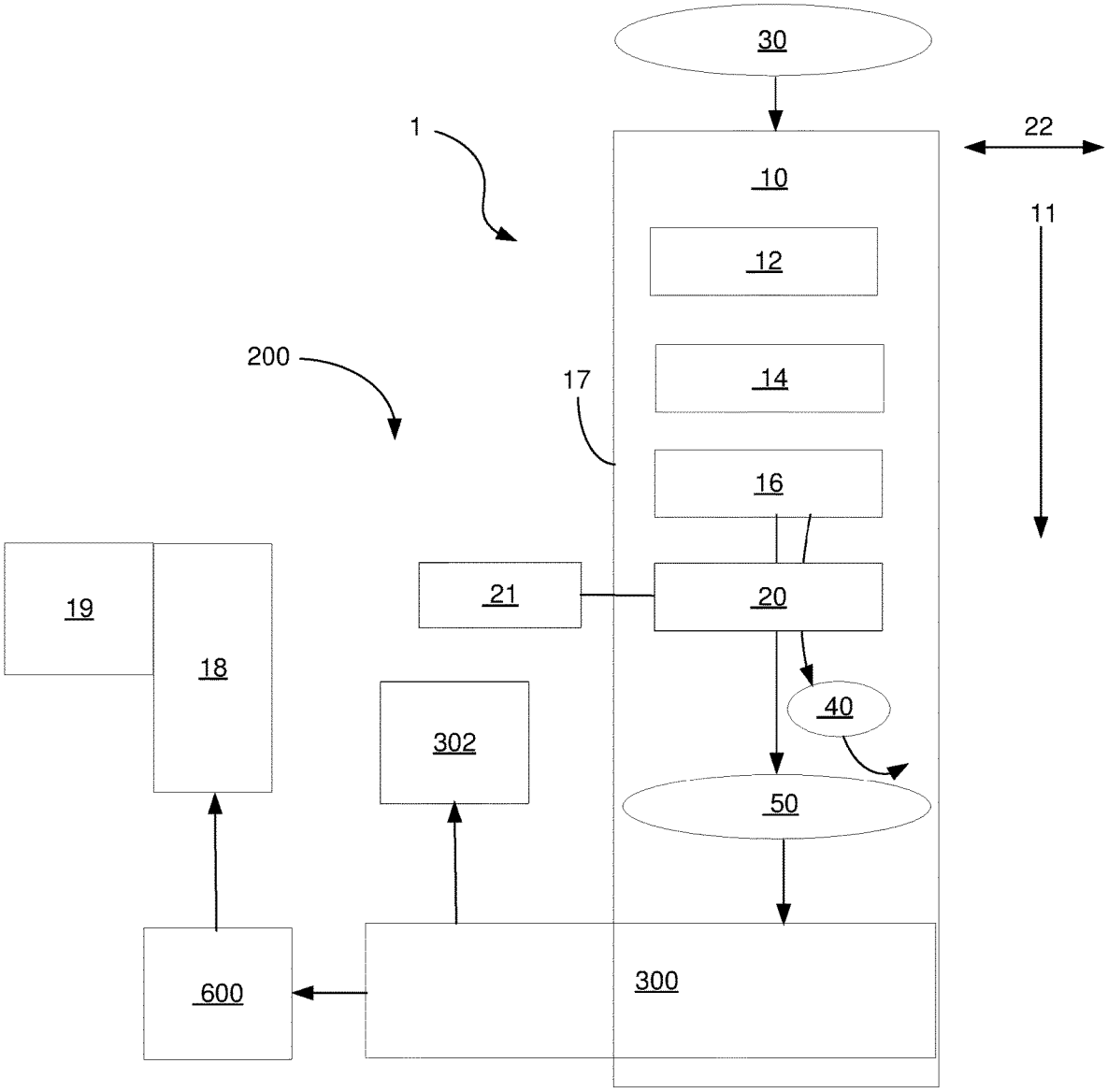
FIG. 2 is a schematic illustration of an exemplary implementation.

FIG. 2 is a schematic illustration of an exemplary_implementation. A typical (e.g., paper or board) machine 1 may be characterized by a machine direction 11 and a cross direction 22. Various "web forming" components are typically mounted within a frame 17. Because typical machines may be several meters wide (or even wider), it may be advantageous to dispose certain components (e.g., of a de-air and/or calming station) "outside the frame" (as opposed to within the wire or clothing loops) which may improve access, reduce defects, reduce deposition of matter, enable cleaning, and the like. Whereas components disposed "within the frame" are typically constrained to dimensions determined by the machine itself (e.g., the rolls and/or paths of the various wires and fabrics), a component situated outside the frame may benefit from less of a constraint on its size and shape.

A forming section 10 of the paper machine may include a head box 12, which injects stock 30 onto a forming wire 14 as it moves around a forming roll 16. The stock may form a web 40 (e.g., of wet paper, board, and the like). A spray of whitewater 50 is typically ejected through the forming wire, and recycled via a flume 18. A water level in the flume 18 may be maintained by an overflow edge or suitable equivalent device 19.

The whitewater spray is typically ejected at high velocities. In some implementations, an optional turbine 20 may be used to harvest energy from the whitewater. Turbine 20 may be coupled to a generator 21 to generate electricity using this energy.

A modern turbine implementation may involve some operating time in which the turbine is engaged, and other times during which the turbine is not engaged. When engaged, the turbine typically results in a substantial slowing of the whitewater spray (after the turbine). When the turbine is disengaged (e.g., during turbine maintenance), the whitewater may have a much higher (or "native") spray velocity. The large difference in velocities (and momenta) between these "engaged" and "disengaged" configurations may create significant challenges with respect to whitewater handling. A prior whitewater handling system configured only to manage the "low speed" whitewater from an engaged turbine may be overwhelmed by the "high speed" whitewater when the turbine is disengaged, and vice versa. It may be advantageous to minimize downtime (e.g., keep the machine operating) during engagement/disengagement of the turbine. As such, the whitewater handling system should accommodate a wide range of whitewater velocities. In an embodiment, a first flow rate of whitewater from a turbine results from the turbine being engaged (e.g., harvesting momentum from the whitewater) and a second flow rate results from the turbine being disengaged (with correspondingly higher momentum past the turbine). A calming station may have an adjustable gate configurable among at least a first position designed for the first flow rate and a second position designed for the second flow rate. A calming station may have a pattern that functions differently at different flow rates. For example, a portion of the gate (or baffle) may have relatively little effect at a low flow rate, but a large effect at a high flow rate (or vice versa).

Various aspects described herein provide for improved handling of whitewater across a range of whitewater spray velocities. In some cases, one of a de-air system and a calming station are designed to handle variable spray velocities. In an embodiment, both the de-air system and the calming station are configured to handle variable spray velocities, and they may be designed to cooperate in this handling of variable velocities.

A paper machine may comprise one or more components of a whitewater processing apparatus 200. Apparatus 200 may include one or more of a de-air system 300, a calming station 600, gate (e.g., an adjustable and/or replaceable gate), a baffle (716), gates and/or baffles having different patterns of slats, holes, gaps, pitches, and the like. An apparatus may include a roof drain 1200 (FIG. 9). These apparatus may be implemented together and/or separately. Various apparatus may be implemented with or without a turbine 20.

Figure 4:
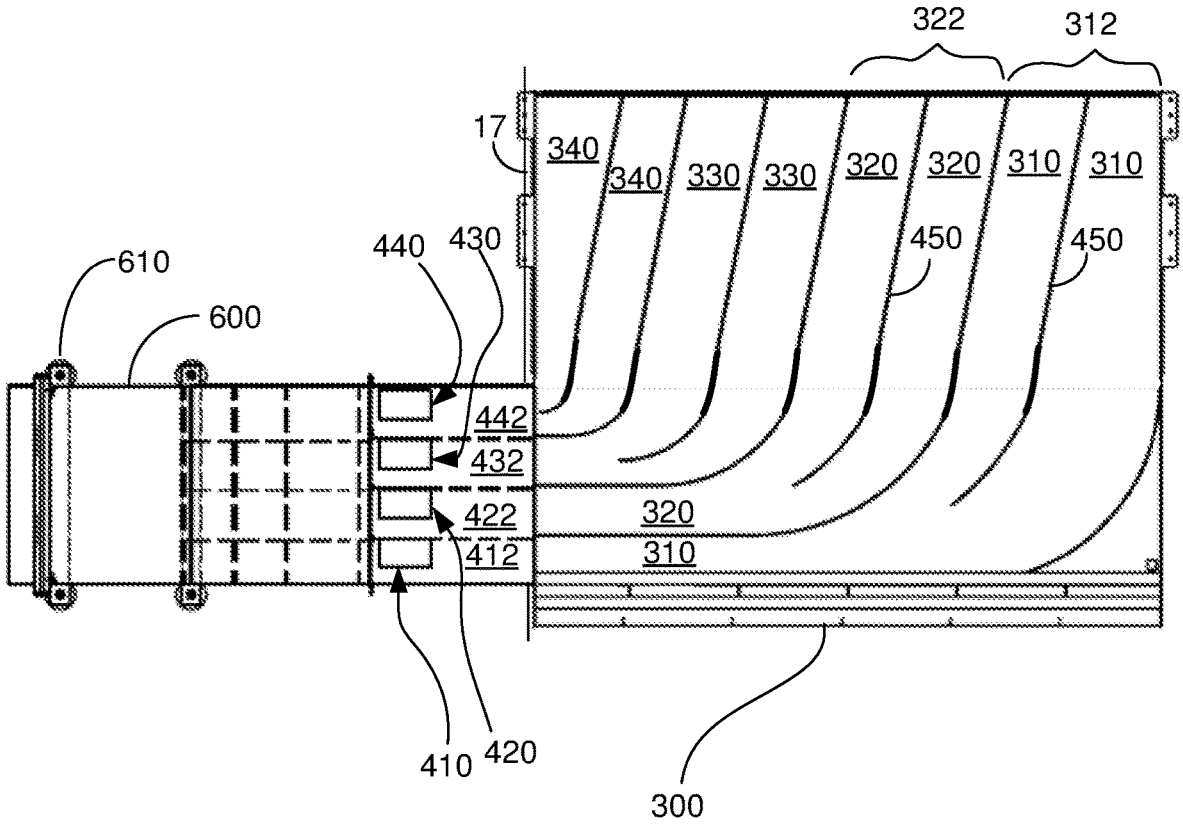
FIG. 4 is a schematic illustration of a plan view, according to some embodiments.

In FIG. 2, an embodiment comprises a de-air system 300 and a calming station 600. The spray of whitewater 50 may be received from the forming section (which may include turbine 20) by de-air system 300. De-air system 300 may collect, "condense" and otherwise capture the spray. De-air system 300 may redirect the spray out of the machine direction (e.g., laterally, such as in cross direction 22) for handling. De-air system 300 may remove air from the liquid whitewater (e.g., with a pump 302, such as a fan evacuating air outlets of the de-air system (FIG. 4).

Liquid water may be collected into flume 18, which may have a flume level controlled by an device 19 such as an overflow edge. In some cases, liquid water may flow directly from de-air system 300 to flume 18. In some cases, a calming station 600 may be disposed between de-air system 300 and the flume. Calming station 600 may reduce turbulence in the liquid water (e.g., prior to its entrance into the flume). Calming station 600 may be designed to accommodate a range of flow velocities. Calming station 600 and/or de-air system 300 may include a baffle, a gate, and/or an adjustable gate that may be adjusted to accommodate different flow velocities, different wire speeds, different stock compositions, concentrations, and the like. Calming station 600 may be implemented without de-air system 300. In an exemplary embodiment, a de-air system 300 is combined with a calming station 600 having at least one of an adjustable gate 610 and a gate having a variable pattern (FIGS. 8A-F). In other implementations, a calming station may not be included, and/or a calming station may have a fixed gate.

Figure 3A:
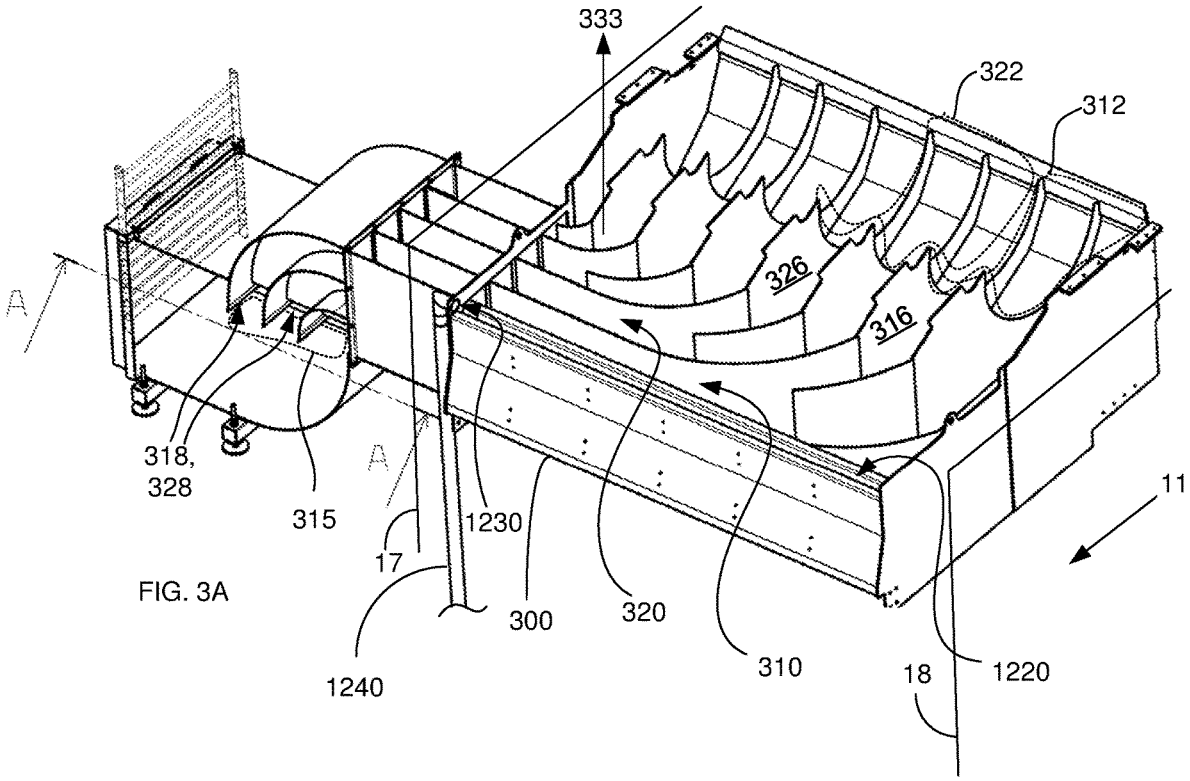
FIGS. 3A and 3B illustrate an exemplary embodiment.
Figure 3B:
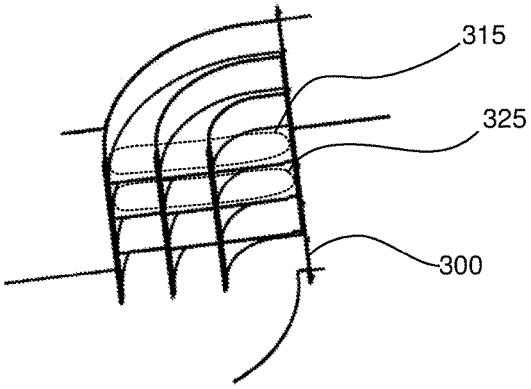

FIGS. 3A and 3B illustrate an exemplary embodiment. FIG. 3A is an illustration in which certain outer surfaces have been removed to show interiors. FIG. 3B illustrates a view from the direction annotated A-A in FIG. 3A. In the embodiment shown in FIGS. 3A and 3B, a plurality of channels is used to redirect respective portions of whitewater from the forming wire spray (not shown) to the flume (not shown). In some cases, entrances to the channels are laterally distributed across the machine, so that a first portion of the spray (e.g., an outer portion) travels through a first channel, and a second portion of the spray (e.g., an inner portion) travels through a second channel.

In some implementations, the density of the whitewater spray (e.g., a relative concentration of water in air) is not uniform across the machine. For example, an outer portion of the spray (associated with a side of the web) may have a higher amount of air than an inner portion. The outer portion of the spray may require the removal of additional air (from its associated water) than the inner portion.

In FIGS. 3A and 3B, a first channel 310 may be defined by one or more first walls 316. Walls may include a ceiling and/or floor of the channel (not shown). First channel 310 is open at a first entrance 312 (near, preferably facing, the spray coming from the forming wire) and may receive a first portion of the spray coming from the forming wire. A second channel 320 is open at a second entrance 322, and may receive a second portion of the spray. Walls 316, 326 of the channels may be shaped to direct the respective portions of the spray down their respective channels, typically in a direction away from the machine direction (e.g., in the cross direction). At least a portion of the walls may be vertical).

The spray (also called a water jet) coming through the forming wire may comprise a gas (e.g., air) and a liquid (e.g., water). One of these phases may be a majority phase (e.g., a continuous phase). A phase may be a minority phase (e.g., droplets in air, bubbles in liquid). Both liquid and gas may be present in approximately equal amounts, and both phases may be substantially continuous. There may be more liquid than gas; there may be more gas than liquid. The spray may be a highly mixed, high velocity, multiphase material. The spray may comprise a small amount of residual material from which the web is fabricated (e.g., fibers).

As the spray flows through the channels, it may be condensed, gathered, and/or segregated into separate phases by the de-air system. A separate phase may include a liquid phase, which may include discrete bubbles. A separate phase may include a gas phase, which may include discrete droplets, such as mist. The channel walls may be designed to induce phase separation in the spray into a majority liquid phase (e.g., water with bubbles) and a majority gas phase (e.g., air, possibly with a mist of fine droplets).

In some embodiments, this phase separation may be used to implement different removal methods for the different phases. A substantially liquid phase (e.g., the condensed water) may be de-aired within the de-air station and/or flume. The gas phase may be used as-is, and/or de-aired in a droplet separator and/or other apparatus designed specifically for the removal of fine particulates from gases (e.g., a cyclone, a porous trap, and the like). A droplet separator may be disposed between a gas outlet and a pump/fan evacuating the gas outlet.

The channels may include separate outlets for gas and liquid. These outlets may be implemented in a way that results in the segregated gas (within each channel) being preferentially removed through its respective gas outlet, and the segregated liquid being preferentially removed through its respective liquid outlet. In FIGS. 3A and 3B, first channel 310 terminates at liquid outlet 315, and second channel 320 terminates at liquid outlet 325. Liquid outlets may comprise a "face down" orientation of the channel walls, in which the terminal edges 318, 328 of the channel walls descend below the flume level (which may be set by the overflow edge, not shown). Such a configuration of outlets may create a "water trap" that allows water to exit the channel, but does not allow gas phase flow into the channel. For example, liquid outlet 315 may prevent the flow of a gas phase into channel 310, yet allow the flow of the liquid phase out of channel 310. This "water trap" may use the mass of the water to "seal" the channel, allowing for evacuation of the gas phase.

Second channel 320 may include its own second entrance 322 open to its respective portion of the whitewater spray. Second walls 326 may concomitantly direct the second portion of the spray to a second liquid outlet 325. Second terminal edges 328 of second walls 326 may be immersed in water at the flume level, such that second liquid outlet 325 allows the egress of liquid from second channel 320, but does not allow entrance of gas into second channel 320. A wall and/or edge of a first channel may also be a wall and/or edge of a second channel (e.g., a wall between two channels).

Gas outlets may be disposed in each respective channel (e.g., in the ceilings of the channels, not shown). Typically, gas outlets are disposed at a point in the channel after which the spray has been condensed and segregated, such that the gas phase may be removed independently of the liquid phase. In some implementations, a wall geometry is chosen that does not substantially disrupt (e.g., maximizes) the forward velocity of the spray (in the machine direction) then gradually induces an acceleration (e.g., laterally). A channel design may be chosen that changes spray direction "smoothly" with minimal loss of momentum, such that the kinetic energy of the spray is efficiently converted to centrifugal forces within the liquid.

In some implementations, at least a portion of a channel wall (316) is locally curved about an axis 333. The location of the curvature may be chosen to generate centrifugal forces in the spray as it travels along the wall, which may encourage segregation of the liquid and gaseous phases. A ceiling 412 (FIG. 4) may be oriented orthogonal to the axis 333, such that an opening 410 (FIG. 4) in the ceiling (typically located slightly downstream of the curved portion) may be located away from liquid flowing along the wall. In some embodiments, an opening 410 is oriented orthogonal to an axis 333 that describes the curvature of the wall inducing centrifugal separation of the whitewater into liquid and gaseous phases. In an embodiment, the curved wall is within 10% of vertical, including within 5% of vertical, and an air outlet is located in the ceiling.

Centrifugal forces may "force" gas bubbles out of the liquid phase. These forces may induce segregation of the gas bubbles (toward the center of the curve) for subsequent removal. The walls may induce laminar flow in the stream. In some embodiments, there are no features in the channels that induce turbulence or mixing in the stream (e.g., no "criss-cross" orientations of first channels meeting second channels).

The gas phase may be removed may be via gas outlets (e.g., air outlets 410, 420, FIG. 4) in the channels. Typically, incoming spray will generate a positive pressure within the channels (via their entrances). The spray may be segregated into liquid and gas phases within the channels. The liquid phase may exit the channels through the liquid outlets (but not the gas outlets), and the gas phase may exit the channels through the gas outlets (but not the liquid outlets). Such a configuration may "seal" each channel, such that a vacuum pump may be used to evacuate the gas phase from each channel.

Typically, a pumped outlet is located far enough downstream (in the channel) that segregation (e.g., via centrifugal force) has been maximized (and thus as much gas as possible removed) prior to gas phase evacuation. In some cases, the outlet is located in a part of the channel where the liquid phase undergoes substantially laminar flow (e.g., the liquid is not being redirected in a way that induces turbulence, as may be done in a calming station to reduce liquid velocity.

Certain embodiments include a single channel. In a multichannel embodiment, the channels may be fluidically separated between their respective entrances and outlets. In an implementation, the machine is operated at a flume level that results in terminal edges of the channel(s) 318, 328 being immersed far enough below the flume level that they "seal" the channels to gas flow (while allowing liquid flow into the flume). In such an implementation, first channel 310 and second channel 320 may be fluidically separated (after their entrances) such that there is substantially no fluidic communication between the channels. As a result, the gas pressures in channels 310 and 320 may be maintained independently of each other. In an embodiment, a lower gas pressure (and/or higher pumping speed) is created in an outer channel (e.g., 310) vs. that in an inner channel (e.g., 320). Such an implementation may improve the removal of (the larger amounts of) air in the outer portions of the whitewater spray.

Some embodiments do not require fluidic independence between channels (and may not even require multiple channels). In certain implementations, a flume level may be set that does not result in terminal edges 318, 328 descending below the flume level.

For the purposes of this specification, "substantially" is defined as "close enough to this condition to provide for an effect caused by this condition." For example, there may be no substantial fluidic communication between two channels, even though small gaps may be present between the channels (e.g., for manufacturing convenience). These gaps may be sealed by liquid flow and/or not be large enough to have an effect on the (lack of) fluidic communication between channels. For example, a small gap between channels may be present, but with suitably high pumping speed (evacuating the gas between channels) the channels may be, for practical purposes, fluidically independent. A "substantially vertical" wall may be slightly off vertical. A "substantially planar" wall may be slightly curved.

FIG. 3A illustrates certain components of an optional roof drain 1200 (FIG. 9). Components (e.g., of a calming station, a de-air system, and/or other apparatus), particularly those located "inside the loop" of forming wire may comprise a roof drain to gather water (e.g., falling off the forming wire or fabric above the apparatus). A roof drain may comprise a roof or other surface to catch water, a gutter (e.g., to collect the caught water), and a drain (e.g., to drain the collected water). A roof drain may cover and/or otherwise protect a component located outside the loop (e.g., outside the frame).

FIG. 4 is a schematic illustration of a plan view, according to some embodiments. In FIG. 4, an inner portion (the right hand side of de-air system 300, within the frame) is shown without its respective ceiling. A middle portion (outside the frame, with features 410-440) shows channel walls comprising ceilings 412 (in first channel 310) and 422 (in second channel 320). An outer portion of de-air system 300 (leftmost in the figure) includes a "turn down" region that directs flow to the respective liquid outlets (in this example, downward with respect to machine direction, or "into the page").

Gas outlets 410, 420, 430, 440 in their respective ceilings 412, 422, 432, 442 may provide for gas removal from their respective channels 310, 320, 330, 340. In some embodiments, gas outlets are disposed in a ceiling of a channel. In some cases, a gas outlet may be disposed in a lateral wall (e.g., an inside wall). A gas outlet may be disposed in a location away from an expected flow of liquid within the channel. For example, the geometry shown in FIG. 4 may be expected to result in segregation of the liquid phase to the "outside" of the channel (e.g., downstream in the machine direction, or toward the bottom of the page as shown on FIG. 4). The gas outlets may be located away from this location to enhance the removal of the gas phase vs. the liquid phase in each channel. Gas outlets may be disposed at different longitudinal positions (with respect to fluid flow). For example, gas outlets may be disposed at different distances (from the center of the forming wire, such as in the cross direction of the machine). It may be advantageous to locate gas outlets "outside" the frame 17. An aggregate pumping volume may be reduced using a compact middle portion (with all the gas outlets in one area). By locating outlets outside the frame, different pumping rates among different channels may be facilitated. By locating gas outlets farther away from the headbox (e.g., downstream of channel walls 450) the whitewater may be more segregated into liquid and gas phases, enabling a more efficient removal of the gas phase.

Gas outlets may be evacuated via a common manifold. In some cases, gas outlets may have different sizes (which may result in variable pumping speeds associated with each channel). For example, an outer gas outlet (e.g., 410) may be larger than an inner gas outlet (e.g., 420) which may provide for increased gas removal from first channel 410, which may have an entrance proximate to a more "misty" spray comprising smaller droplets (as compared to second channel 320). In some cases, separate ducts (or even separate pumps/fans) are provided for separate gas outlets. In some cases, an adjustable outlet size may be implemented. An outlet size may be adjusted by choosing different size flaps that partially cover the outlet. An outlet size may be adjusted via a throttle mechanism (that controllably blocks the outlet, such as a butterfly valve).

In certain embodiments, a channel may include internal walls to enhance flow. In FIG. 4, internal walls 450 may be used to preferentially guide the whitewater spray within a channel. A channel wall may be straight or curved. In some embodiments, a wall is curved in two directions (e.g., a concave wall, such as a wall comprising a portion of a paraboloid, a hyperboloid, a sphere, and the like).

Figure 5A:
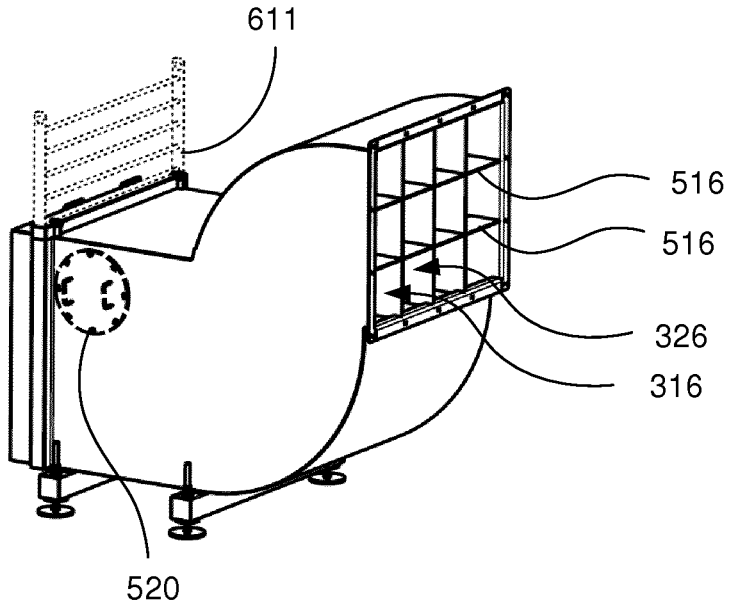
FIGS. 5A and 5B illustrate exemplary embodiments of channel geometries.
Figure 5B:
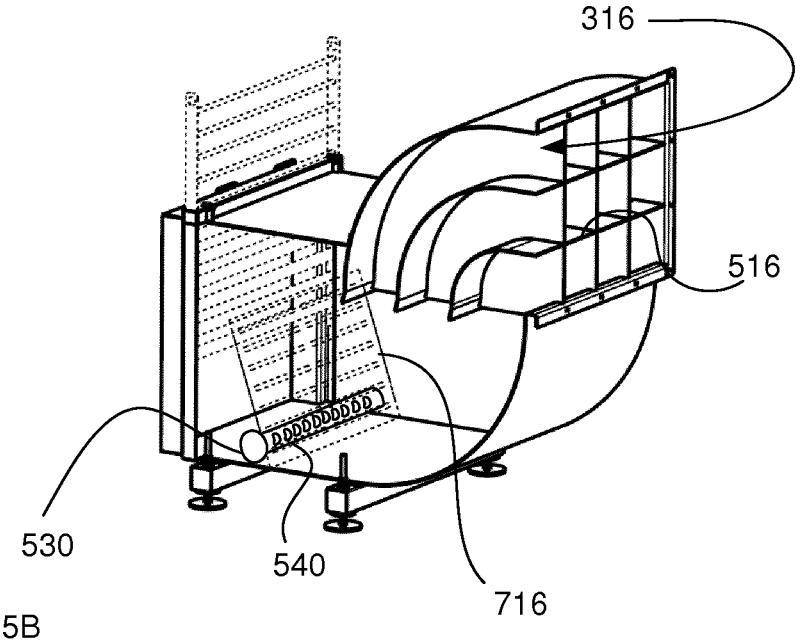

FIGS. 5A and 5B illustrate exemplary embodiments of channel geometries. In some cases, optional horizontal walls 516 may be implemented within a channel (e.g., to control liquid flow in the channel). Horizontal walls 516 may be located in a region of the channel at which the whitewater is expected to have been segregated (into separate phases) and/or slowed down (e.g., via curved portions prior to the horizontal walls). In such an implementation, walls may be designed to reduce turbulence and/or reduce velocity of the liquid phase flowing out of the system. Various embodiments do not include such walls.

FIG. 5A illustrates an optional cleanout 520 (in this example, above the flume level, and in a calming station) which may be used to access an interior of the apparatus. FIG. 5B illustrates an optional cleanout 530 (in this case, below the flume level). Cleanout 530 may be coupled to an internal tube 540 (e.g., with holes), and may be sealably accessed to extract material from the liquid within the apparatus. In an embodiment, tube 540 is located in an eddy region, in which liquid flowing through the apparatus is expected to form eddy currents. Solids may settle out in an eddy region, and tube 540 may be used to extract (e.g., suck out) the settled solids. In FIG. 5B, an optional baffle 716 is shown, and tube 540 is located on a leeward side of the baffle where solids may preferentially settle. A cleanout may be disposed in a de-air system, a calming station, and/or other apparatus. FIG. 5A illustrates an optional gate 611 (in this example, a replaceable gate midway through a replacement motion).

A calming station may comprise one or more features designed to improve fluid flow, which may increase flume performance. A calming station may reduce turbulence in the liquid, which may reduce convection in the flume. Reduced convection may improve the rate at which small air bubbles rise to the surface (and leave the liquid phase), particularly for small air bubbles that might be "dragged down" toward the bottom of the flume by convection within the liquid.

A calming station may dissipate or otherwise reduce energy within the liquid. A calming station may make a velocity profile (over a cross section of the liquid) more uniform.

A calming station may comprise one or more baffles and/or gates configured to modify fluid flow within the calming station. Fluid flow may be modified by a shape of the solid portion of a baffle or gate (e.g., of a slat). Fluid flow may be modified by a shape of an open portion (e.g., of a hole or a gap between slats.) A pattern may comprise one or more holes, one or more slats, and/or other features designed to affect fluid flow. The use of a term such as "hole" or "slat" is for convenience. Various manufacturing techniques may be used to make different features having similar functionality (e.g., cutting holes in a plate may impart similar functionality as adding slats to a frame) and should not be construed as limiting.

Figure 6A:
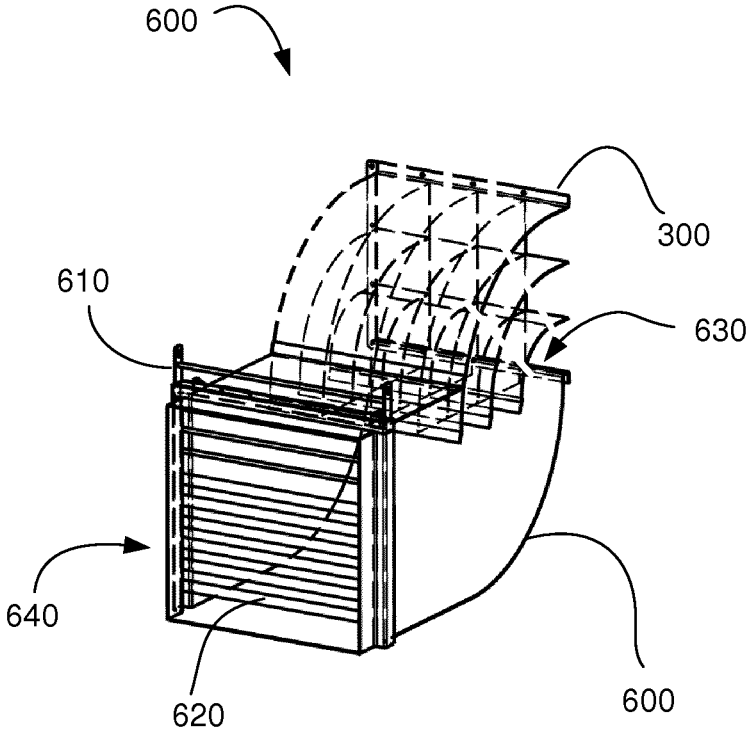
FIGS. 6A and 6B illustrate aspects of a calming station, according to some embodiments.
Figure 6B:
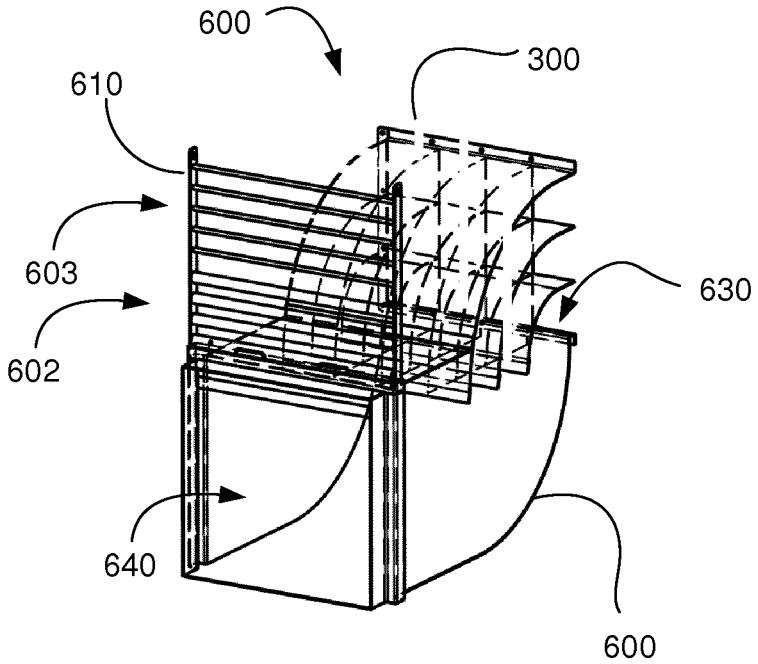

FIGS. 6A and 6B illustrate aspects of a calming station, according to some embodiments. A calming station may comprise an inlet 630 (e.g., for liquid) and an outlet 640 (e.g., for liquid). A calming station may comprise one or more gates (which may be fixed or adjustable) and/or one or more baffles (which may be solid or have slats, holes, or other patterns). A gate and/or baffle may comprise a pattern (e.g., of holes, slats, bars, ridges, pitches, and the like) that affects fluid flowing in or around the gate. The pattern may be chosen according to one or more expected flow conditions, and designed to optimize the dissipation of momentum in the liquid water prior to entrance into the flume. A pattern may reduce turbulence in the flowing water. A pattern may inhibit flow in certain regions and/or enhance flow in other regions (e.g., to make the flow more uniform). A pattern may vary over a gate and/or baffle (e.g., horizontally, vertically). A gate or baffle may have a pitch (through its thickness) designed to impart a force on a fluid flowing through the gate/baffle (e.g., to direct the flow in a desired direction).

In the example shown in FIGS. 6A and 6B, part of an optional de-air system (300) is shown. A calming station may be implemented with or without a de-air system.

Air removal from the liquid phase (e.g., in the flume) often requires the removal/reduction of small air bubbles from the liquid. These bubbles may be smaller than those that are readily removed during upstream processes, and may require relatively long residence times before they can float up and out of the flume. Turbulence and/or convection in the flume may "sweep" air bubbles that are close to the surface down into the flume, inhibiting their removal.

A calming station may be implemented to minimize convection and/or turbulence in the flume, which may improve flume performance (e.g., the efficiency with which the so-called "fan pump" pressurizes the stock for use in the headbox). An increased efficiency of bubble removal from the liquid may provide for a smaller flume length and/or flume width, which may reduce complexity and/or cost of an implementation. In an embodiment, a de-air system removes a first portion of air from the whitewater, condensing a spray from the forming wire into a liquid and sending the condensed liquid to a calming station. The liquid may comprise a small amount of remaining air bubbles. The calming station prepares the liquid for the flume (e.g., reducing turbulence, enhancing fiber removal, reducing maintenance times on fiber-removal filters (e.g., pre-fan pump) and the like). The flume then "scavenges" at least a portion of the remaining air from the calmed water.

A calming station may be shaped (e.g., with internal surfaces, gates, slats, holes, baffles, and the like) to improve air removal from water in the flume. A bottom surface of a calming station may be shaped to smoothly direct incoming water (e.g., from a de-air station) toward the flume. In some embodiments, a calming station may comprise eddies and/or stagnant zones that enhance or implement the removal of residual solids (e.g., fibers) from the water (e.g., with a stagnant or eddy zone that induces settling of the fibers in a readily "cleanable" place). In some embodiments, a calming station and/or a de-air system has a "clean design" that minimizes (or even eliminates) stagnant zones and/or eddies. A calming station may include one or more gates and/or one or more baffles, disposed, shaped, and having features designed to improve flume performance.

FIGS. 6A and 6B illustrate different configurations of an adjustable gate 610. In some cases, whitewater flow rates may vary significantly. For example, when a turbine is installed, flow rates may vary from very high velocities (when the turbine is disengaged) to relatively lower velocities (when the turbine is harvesting energy from the whitewater spray). Preferably, a de-air station and/or a calming station accommodates such a variation in flow velocities when implemented in a machine where this variation may present itself. Variable velocities may be accommodated with an adjustable gate. Variable velocities may be accommodated with a gate or baffle having a nonuniform pattern (e.g., of holes, slats, and the like).

Adjustable gate 610 may be used to accommodate different flow velocities prior to the flume. A pattern (e.g., of one or more slats 620 and/or holes (not shown)) may be designed to impart a desired effect (e.g., on the liquid) when immersed. A position of an adjustable gate may determine which portion of the fluid is affected at a particular time, enabling adaption of the system to variable flow velocities.

FIG. 6A shows a lowered gate, which may be used to slow or "brake" the liquid using one or more slats 620 (or alternately, remaining portions after holes have been machined). A "braking" configuration may be advantageous with high liquid velocities (e.g., with a disengaged turbine). FIG. 6AB shows a raised gate, in which the liquid is not forced to flow through the slats/holes. Such a configuration may reduce turbulence and/or convection in a slow moving liquid, notwithstanding that it may not be optimal for a fast moving liquid. A raised gate may be used, for example, when a turbine is engaged. FIGS. 6A and 6B illustrate a pattern (in this example, of slats 620) that varies vertically. In this example, a lower portion of the slats has a cross sectional area (of the slats) that is larger than that of an upper portion, and gap distances between slats are smaller. As a result, a lower portion of the gate may inhibit flow more than the upper portion.

A gate may include a pattern of holes, slats, and/or other features that affects flow through or around the gate. The pattern may vary over a cross sectional area of the gate. The pattern may vary through the gate (e.g., a pitch of the slats or holes through a relatively thick gate). A gate may be adjusted and/or changed out (e.g., during operation). A gate may be adjusted in response to turbine engagement/disengagement, a change in forming wire speed, a change in headbox velocity, a change in stock concentration, a change in stock composition, and/or a change in other process parameters. An adjustable gate may be implemented with a de-air system, a calming station, and/or other apparatus.

Figure 7A:
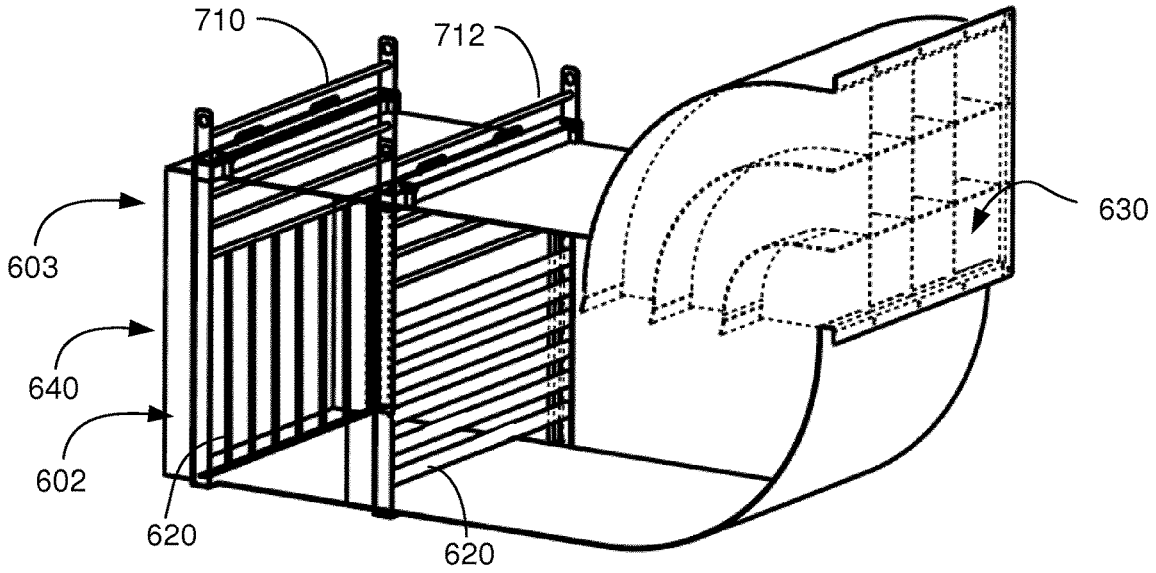
FIG. 7 A is a schematic illustration of multiple gates, according to some embodiments.
FIG. 7B is a schematic illustration of a baffle, according to some embodiments.

FIG. 7 A is a schematic illustration of multiple gates, according to some embodiments. A calming station, a de-air system, and/or another apparatus may include one or more gates configured to modify a flow of fluid (gas or liquid). In an exemplary embodiment, a gate is disposed as part of a calming station 600. In FIG. 7A, an adjustable gate 710 has a first pattern (e.g., of slats 620) comprising vertical slats in a lower portion and horizontal slats in an upper portion. The portions may have different slat sizes, different spacings between the slats, and/or different slat pitches. The portions may be implemented with holes, rather than slats. In FIG. 7A, a fixed gate 712 has a second pattern of slats 620, comprising horizontal slats having a varying slat width and slat spacing (in a vertical direction).

A high velocity flow may result in a relatively larger difference among flow velocities (over a cross section of the calming station) than a small velocity flow. For example, an engaged turbine might result in relatively uniform flow rates (entering the calming station) while a disengaged turbine might result in some regions having very high flow and some regions having lower flow. A gate or baffle design may accommodate these differences. In an embodiment, a portion of the gate or baffle that is "upstream" with respect to the machine direction is more restrictive than a "downstream" portion (e.g., that receives slower moving water). A vertically lower portion may have a denser pattern than a portion closer to the top of the flume. A first gate may cause fast laminar flow to dissipate (e.g., impart turbulence) and a second gate may reduce this turbulence, resulting in a slow, minimally turbulent liquid exiting the calming station.

Gates may have patterns of holes (not shown). An embodiment may comprise two or more adjustable (e.g., replaceable gates). An adjustable/replaceable gate may be adjusted/replaced while the machine is running, allowing for adjustment of the flow properties (e.g., into the flume) without requiring machine shutdown.

Figure 7B:
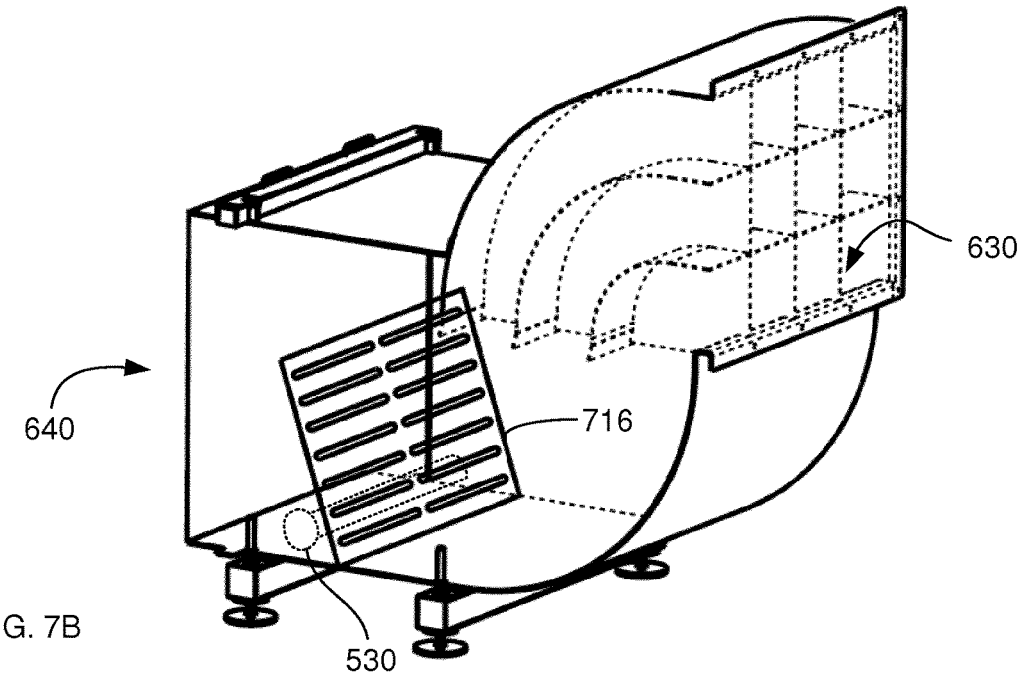
Figures 8A, 8B, 8C, 8D, 8E, 8F:
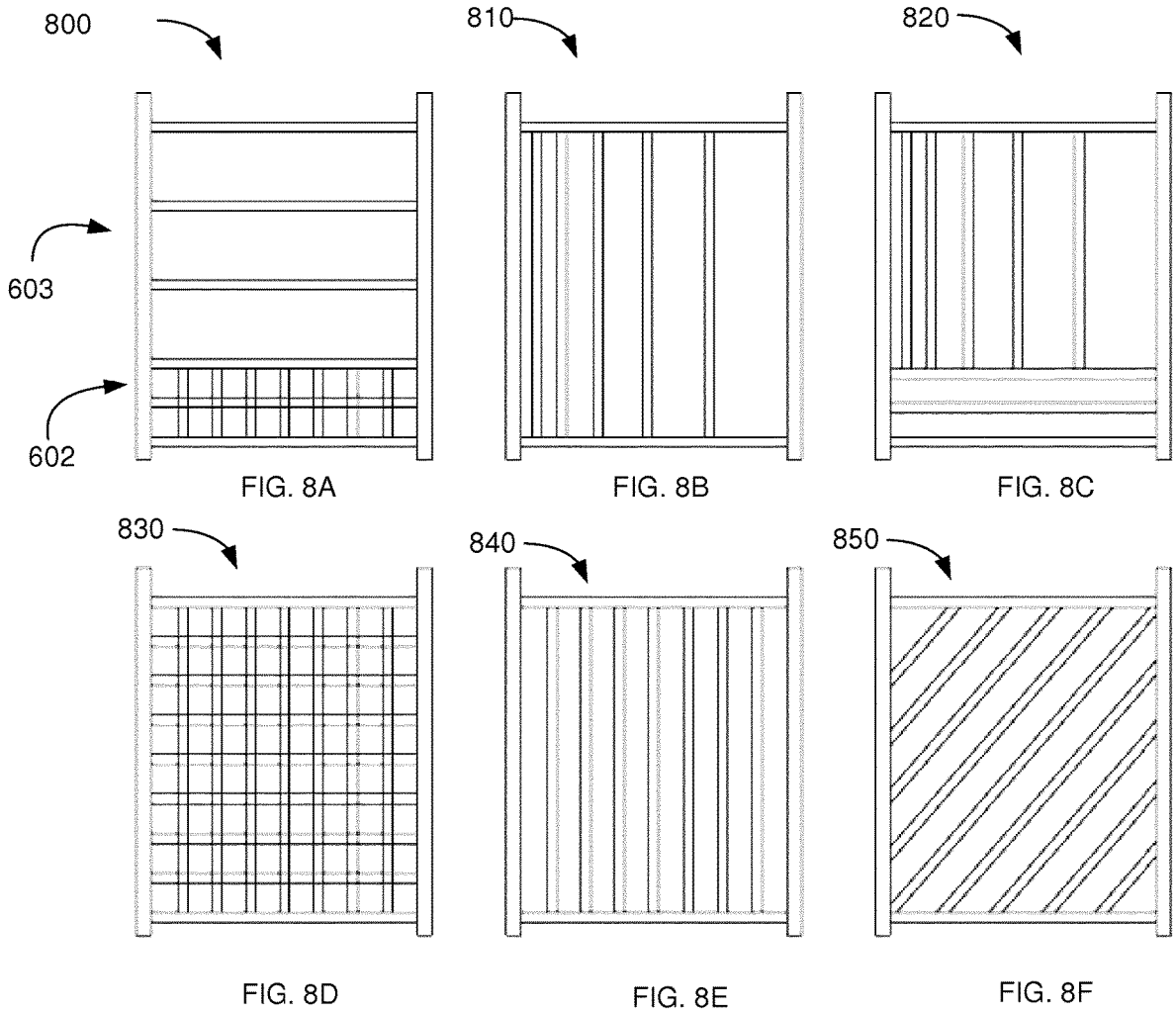
FIGS. 8A-8F illustrate exemplary patterns, according to some embodiments.

FIG. 7B is a schematic illustration of a baffle, according to some embodiments. A baffle 716 may be disposed in a fluid path (e.g., in a liquid path) and may modify the flow of the fluid in an advantageous way. A baffle may reduce the velocity of the fluid, reduce turbulence in the fluid, and the like.

A baffle and/or a gate may comprise one or more slats, gaps, or holes. A baffle and/or gate may have a pattern that varies over its cross sectional area and/or through its thickness. In some cases, a pattern of holes/slats in a "high speed" part of the flow may be different than that in a "low speed" part of the flow. For example, a first pattern may be aligned with a channel expected to yield a high flow velocity (e.g., channel 340, FIG. 3) and a second pattern may be aligned with a channel expected to yield a lower flow velocity (e.g., channel 310, FIG. 3). A baffle may be solid, may comprise slats 620 (not shown), and/or holes. A baffle may be angled with respect to a surface to which the baffle is attached.

A baffle may be configured to create an eddy or substantially stagnant zone. A baffle may be configured to reduce or prevent the creation of eddies or stagnant zones. In the example shown in FIG. 7B, exemplary baffle 716 may be configured to create a relatively stagnant zone under certain flow conditions, and an optional cleanout 530 is disposed with its respective tube in the stagnant zone. In an embodiment, a paper machine is operated at a flow condition designed to induce settling of solids in a stagnant or eddy zone, and cleanout 530 is operated at or after that flow condition to extract the solids.

FIGS. 8A-8F illustrate exemplary patterns, according to some embodiments. Patterns of slats, gaps, or holes may be used for a baffle, a gate, and/or a combination thereof. For simplicity, the patterns in FIGS. 8A-F are describe as if used in gates (which may be fixed or adjustable) and with the pattern described in terms of slats.

Gate 800 illustrates a higher slat density at a bottom of the gate and a different slat pattern in upper (horizontal) and lower (crosshatch) portions. Gate 810 illustrates a slat density that varies laterally (e.g., from denser pattern associated with a high velocity portion of the flow to a more open pattern for the lower velocity portion). Gate 820 illustrates a gate having a combination of horizontal and vertical slats, in this case with the vertical slats having a horizontal variation in slat density. Adjustable gate 830 illustrates a crosshatch pattern of slats. Gate 840 illustrates a gate having vertical slats (e.g., with different pitches). Gate 850 illustrates an angled pattern of slats.

A desired pattern may be chosen according to particular operating conditions. In some cases, a machine is operated with a first gate at a first condition, the first gate is swapped for a second gate, and the machine is operated with the second gate at a second condition.

Figure 9A:
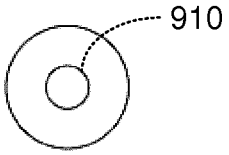
FIGS. 9A-F illustrate various slat cross sections, according to some embodiments.
Figure 9B:
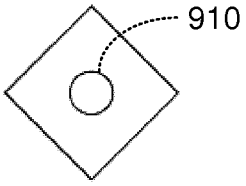
Figure 9C:
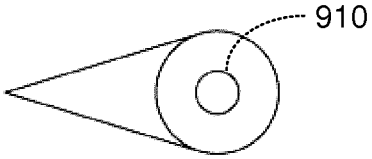
Figure 9D:
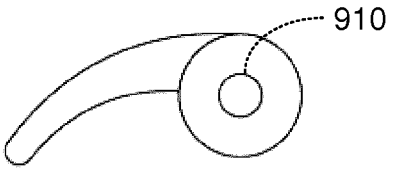
Figure 9E:
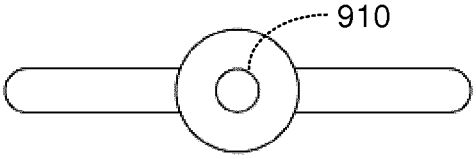
Figure 9F:
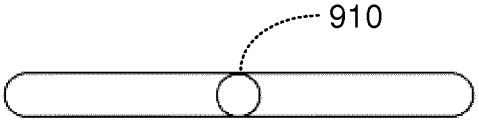

FIGS. 9A-F illustrate various slat cross sections, according to some embodiments. A slat cross section may be chosen that imparts a preferred velocity to the flowing fluid (e.g., pushes the fluid up, down, or to the side). FIG. 9A illustrates a slat with a round cross section. FIG. 9B illustrates a slat with a square (or diamond-shaped) cross section. A parallelogram or other shape may also be implemented. FIG. 9C illustrates a slat with an asymmetrical cross section (e.g., a rounded face and a pointed face). FIG. 9D illustrates a curved slat comprising a concave surface, which may include a wing cross section. FIGS. 9E and 9F illustrate flat slats having different diameter center sections.

An adjustable gate may comprise adjustable slats. Slats may themselves be adjustable (e.g., pivotable around optional axes 910), which may provide for accommodation of different flow conditions.

Figure 10:
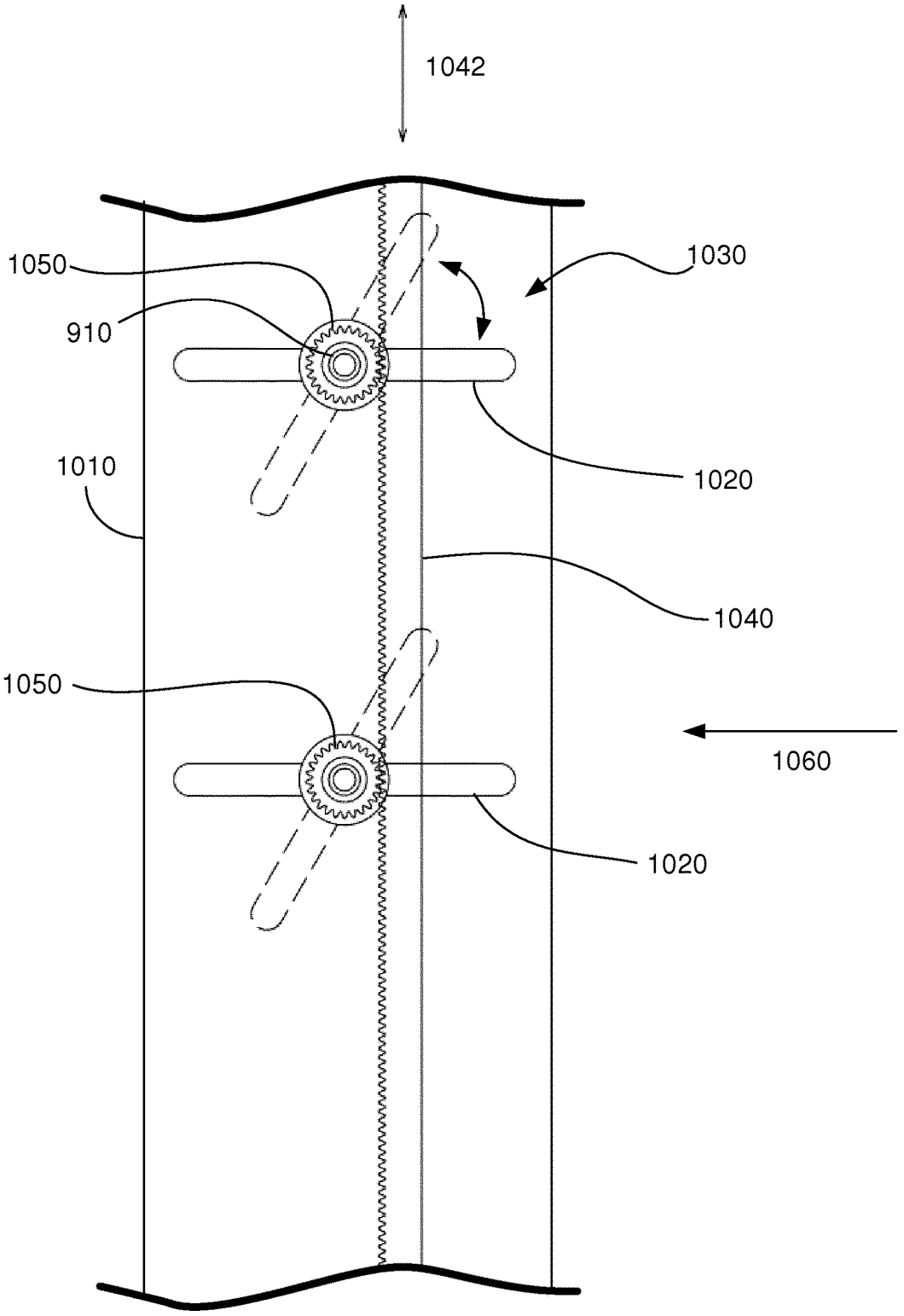
FIG. 10 is a schematic illustration of an adjustable pattern, according to some embodiments.

FIG. 10 is a schematic illustration of an adjustable pattern, according to some embodiments. Gate 1010 may comprise one or more slats 1020, bars, ridges, and the like, and a linkage 1030 configured to adjust the slats (e.g., adjust a pitch of the slats), bars, ridges, and the like. Linkage 1030 may comprise a rack and pinion linkage, a four-bar linkage (not shown) and/or other linkages. In FIG. 10, linkage 1030 comprises a bar or rack 1040 configured to move in a direction 1042. Rack 1040 is coupled to blades 1020 via pinions 1050 (e.g., with mating geared surfaces). Movement of rack 1040 in direction 1042 may adjust the angle of slats 1020 (e.g., with respect to a direction 1060 of fluid flow). Direction 1042 may be vertical and/or horizontal.

Figure 11:
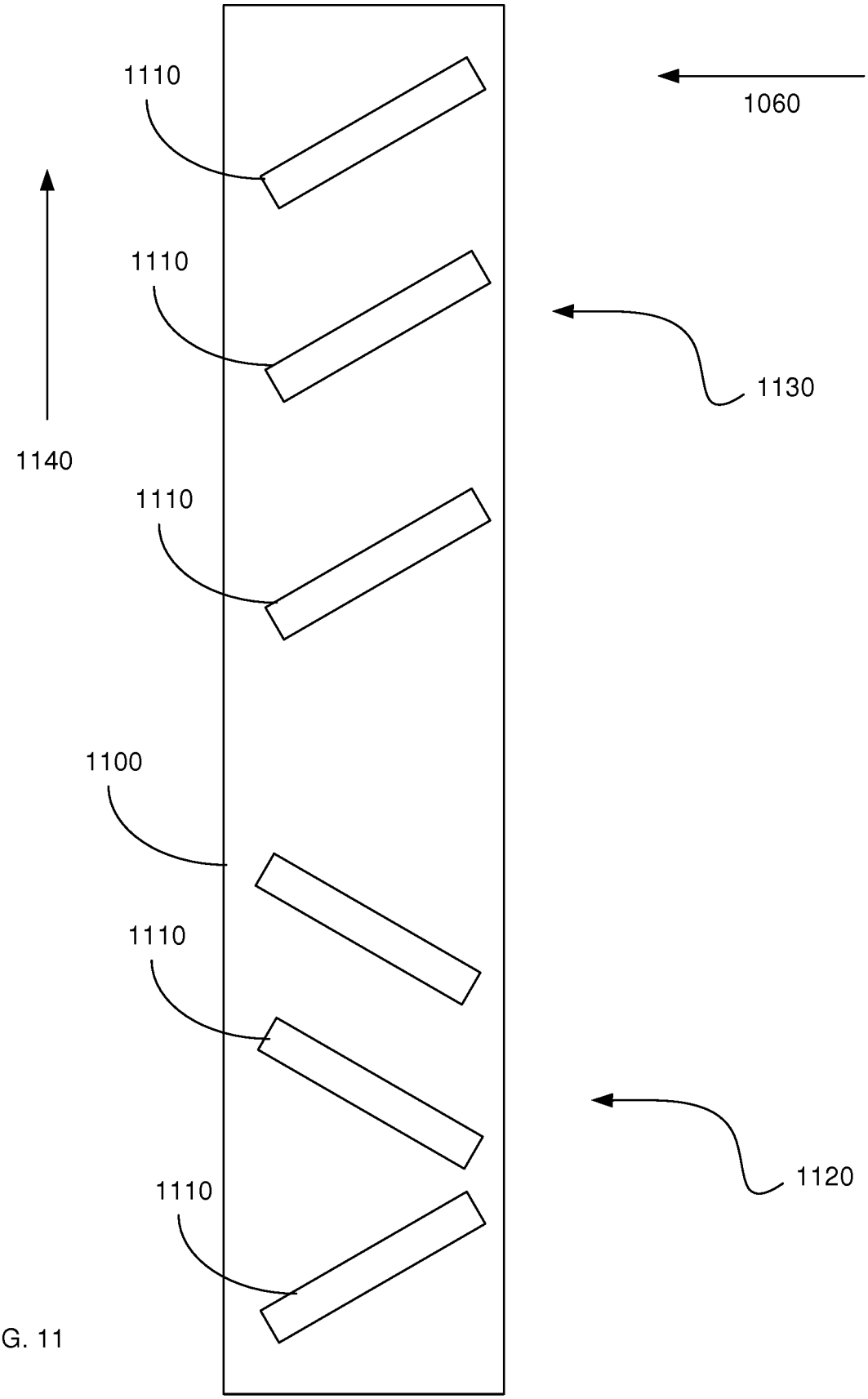
FIG. 11 illustrates a gate having slats with varying pitches, according to some embodiments.

FIG. 11 illustrates a gate having slats with varying pitches, according to some embodiments. Gate 1100 may comprise slats 1110 having different pitches (e.g., with respect to fluid flow direction 1060). A first portion 1120 of the gate may include a first pitch, and a second portion 1130 of the gate may include a second pitch. The portions may be disposed with respect to each other in a direction 1140 (e.g., horizontal, vertical). A first portion may be disposed in a region expected to have a first flow velocity and a second portion may be disposed in a region expected to have a second flow velocity. In an embodiment, first portion 1120 comprises a higher pitch (e.g., larger angles) and is disposed near a bottom of the gate and/or near a higher velocity side of the gate.

Figure 12:
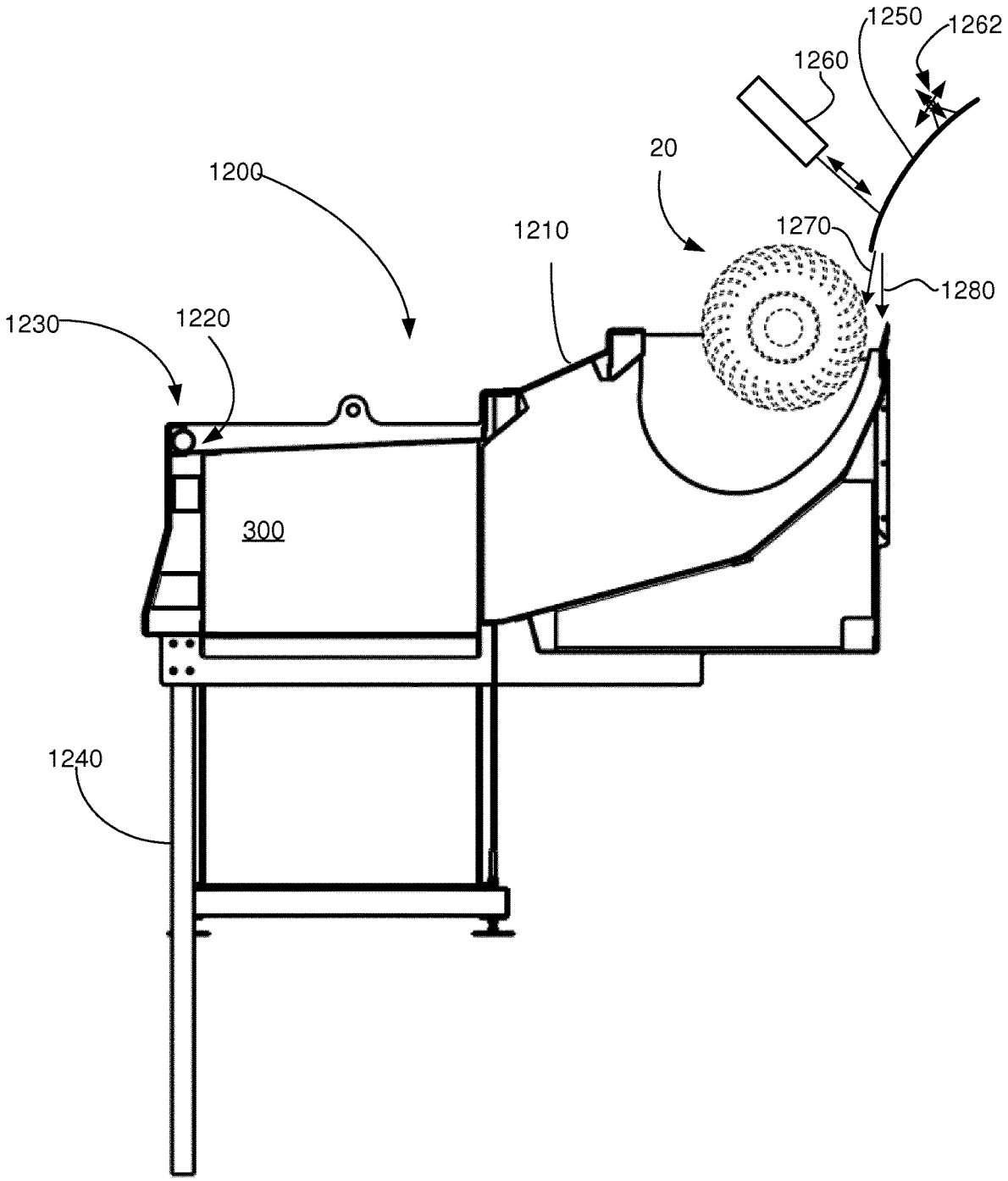
FIG. 12 illustrates an exemplary implementation with a turbine, according to some embodiments.

FIG. 12 illustrates an exemplary implementation with a turbine, according to some embodiments. A de-air system configured for use with a turbine may comprise one or more channel entrances having leading edges that are shaped to "wrap around" the turbine. A leading edge 350 of a channel (e.g., defining the entrance to the channel) may be shaped (e.g., curved) to "wrap around" a turbine. Such geometry may improve spray flow within the channel, minimize splash-back onto the forming wire, and/or minimize fluid communication between the channels. A leading edge may have a radius of curvature that is at least as large as the outer radius of the turbine, including at least 1% larger, including at least 5% larger.

A modern turbine implementation may comprise a mechanism to engage or disengage the turbine. In some embodiments, an engagement mechanism comprises an adjustable mount configured to move the turbine into or out of the spray ejected through the forming wire. An engagement mechanism may comprise an adjustable guide plate 1250 configured to guide the spray ejected through the forming wire into (or away from) the turbine. The guide plate may be actuated by an actuator 1260. The actuator may cooperate with a pivot 1262 (that may have an adjustable location of its pivot point) around which the guide plate pivots. The actuator and/or pivot may control a position of the guide plate (e.g., with millimeter precision and/or within 2 degrees of a desired angle of attack) to locate the guide plate in that position which most efficiently transfers momentum from the spray to the turbine. In some cases, the actuator may be used to engage/disengage the turbine. For example, positioning guide plate 1250 in a first position may direct the spray in a direction 1270 into the turbine (engaging the turbine), and positioning guide plate 1250 in a second position may direct the spray in a direction 1280 away from the turbine (disengaging the turbine). In this example, de-air system 300 comprises a channel shape configured to accommodate the sprays from both the engaged and disengaged positions.

FIG. 12 illustrates certain features of a roof drain, according to some embodiments. Certain machines may generate a significant "mist" around the forming section, which may deposit or even "rain" onto various surfaces. Various apparatus may be disposed in an intrinsically "wet" location (e.g., "inside the loop" of forming wire). A roof drain 1200 may collect water in a manner that improves safety and/or performance. A roof drain may be implemented with a calming station, a de-air system, and/or other apparatus.

Roof drain 1200 may comprise a sloped roof 1210, which may descend to a gutter 1220. Gutter 1220 may collect water landing on roof 1210 and guide the water to a drain 1230, which may lead to an optional downspout 1240.

Various features described herein may be implemented independently and/or in combination with each other. An explicit combination of features does not preclude the omission of any of these features from other embodiments. The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A calming station configured for use with a forming section of a paper machine to reduce turbulence in a liquid flowing from the forming section into a flume of the paper machine, the calming station comprising:

a liquid inlet configured to receive the liquid;

a liquid outlet configured to convey the liquid out of the calming station; and a gate through and/or around which the liquid may flow, the gate having a pattern of one or more holes, bars, slats, ridges, and/or grooves, configured to modify the flow of liquid through and/or around the gate, the gate comprising least one of:

an adjustable gate configurable among two or more different positions that alter the flow of the liquid in different ways; and a first portion having a first pattern of one or more holes, bars, slats, ridges, and grooves, and a second portion having a second pattern of one or more holes, bars, slats, ridges, and grooves different than the first pattern.

2. The calming station of claim 1, wherein the gate comprises the adjustable gate, and the adjustable gate has the first portion having the first pattern and the second portion having the second pattern.

3. The calming station of claim 1, wherein the pattern of one or more holes, bars, slats, ridges, and/or grooves includes a pitch in a fluid flow direction with respect to the gate, and the gate has:

a first portion having a first pitch, and a second portion having a second pitch.

4. The calming station of claim 1, wherein the pattern comprises an adjustable pattern.

5. The calming station of claim 4, wherein the adjustable pattern comprises one or more slats having an adjustable pitch.

6. The calming station of claim 1, wherein at least one gate comprises a pattern of one or more holes, bars, slats, ridges, and/or grooves that varies over a vertical distance.

7. The calming station of claim 1, further comprising:

a baffle proximate to a bottom of the calming station, at least a portion of the baffle shaped to redirect a flow of water into, within, and/or out of the calming station; and at least one cleanout disposed proximate to the bottom of the calming station and sealably openable to extract material from the calming station.

8. The calming station of claim 7, wherein the cleanout is coupled to a tube disposed in a region expected to form an eddy during operation of the calming station.

9. The calming station of claim 1, further comprising:

a first gate having the adjustable gate; and a second gate comprising the first and second portions.

10. The calming station of claim 1, further comprising a de-air system for processing a whitewater spray ejected from a forming wire in the forming section, the de-air system being disposed between the forming wire and the calming station, the de-air system comprising:

channels defined by walls shaped to direct a portion of the whitewater spray away from the machine direction, the channels open at first entrances proximate to the forming wire and terminating at liquid outlets proximate to the liquid inlet of the calming station and defined at least in part by one or more terminal edges; and air outlets providing for air evacuation from the channels;

wherein, between the respective first entrances and liquid outlets of the de-air system, and excluding the air outlets, there is no substantial fluid communication between the channels.

11. The calming station of claim 1, further comprising a de-air system for processing a whitewater spray ejected from a forming wire in the forming section, the de-air system disposed between the forming wire and the calming station, the de-air system comprising:

channels defined by walls shaped to direct a portion of the whitewater spray away from the machine direction, the channels open at first entrances proximate to the forming wire and terminating at liquid outlets proximate to the liquid inlet of the calming station and defined at least in part by one or more terminal edges; and air outlets providing for air evacuation from the channels, wherein the walls comprise side walls for which a majority of the side walls is within 10 degrees of vertical.

12. A paper machine comprising the calming station of claim 11.

13. The calming station of claim 1, further comprising a de-air system for processing a whitewater spray elected from a forming wire in the forming section, the de-air system disposed between the forming wire and the calming station, the de-air system comprising:

channels defined by walls shaped to direct a portion of the whitewater spray away from the machine direction, the channels open at first entrances proximate to the forming wire and terminating at liquid outlets proximate to the liquid inlet of the calming station and defined at least in part by one or more terminal edges; and air outlets providing for air evacuation from the channels, wherein less than 5% of a cross sectional area of the channels is intersected by a free upstream end of a part.

14. A paper machine comprising the calming station of claim 13.

15. The calming station of claim 1, wherein the gate comprises the adjustable gate.

16. The calming station of claim 1, wherein the gate comprises the first and second portions.

17. A paper machine comprising the calming station of claim 10, wherein the air outlets are disposed outside a frame of the paper machine.

18. The paper machine of claim 17, wherein an inner portion of the de-air system is disposed inside the frame of the paper machine, and an outer portion comprising the liquid outlets of the de-air system is disposed outside the frame.

19. A method for managing a flow of liquid water into a flume of a paper machine, the method comprising the steps of:

providing a calming station according to claim 1, the liquid outlet of the calming station being coupled to the flume; and reducing a turbulence in the flow of liquid water into the flume with the calming station.

* * * * *